US012320199B1

(12) United States Patent
Morin et al.

(10) Patent No.: US 12,320,199 B1
(45) Date of Patent: Jun. 3, 2025

(54) CUTTING ELEMENTS AND GEOMETRIES FOR REDUCED VIBRATIONS, EARTH-BORING TOOLS, AND RELATED METHODS

(71) Applicant: Baker Hughes Oilfield Operations LLC, Houston, TX (US)

(72) Inventors: John Morin, The Woodlands, TX (US); Xu Huang, Spring, TX (US); Franklin Guillermo Valbuena, Conroe, TX (US); Stephen Duffy, Spring, TX (US); Eliah Everhard, The Woodlands, TX (US); Armin Kueck, The Woodlands, TX (US); John Abhishek Raj Bomidi, Peral River, NY (US); Michael L. Doster, Centerville, TX (US)

( * ) Notice: Subject to any disclaimer, the term of this patent is extended or adjusted under 35 U.S.C. 154(b) by 0 days.

(21) Appl. No.: 18/517,613

(22) Filed: Nov. 22, 2023

Related U.S. Application Data

(60) Provisional application No. 63/384,709, filed on Nov. 22, 2022.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673; E21B 10/5671
See application file for complete search history.

(56) References Cited

U.S. PATENT DOCUMENTS

| | | | | |
|---|---|---|---|---|
| 4,872,520 | A * | 10/1989 | Nelson | E21B 10/60 175/430 |
| 5,115,873 | A * | 5/1992 | Pastusek | E21B 10/60 175/429 |
| 9,103,174 | B2 | 8/2015 | DiGiovanni | |
| 10,006,253 | B2 | 6/2018 | DiGiovanni et al. | |
| 10,337,255 | B2 | 7/2019 | DiGiovanni et al. | |
| 11,035,177 | B2 * | 6/2021 | Dubose | E21B 10/56 |
| 11,060,356 | B2 * | 7/2021 | Cuillier De Maindreville | E21B 10/5735 |

(Continued)

FOREIGN PATENT DOCUMENTS

| | | | | |
|---|---|---|---|---|
| CN | 214498921 | | 10/2021 | |
| WO | WO-2021080900 | A1 * | 4/2021 | E21B 10/5673 |
| WO | WO-2024112905 | A1 * | 5/2024 | |

OTHER PUBLICATIONS

International Search Report for Application No. PCT/US2023/080936 dated Mar. 22, 2024, 4 pages.

(Continued)

*Primary Examiner* — Jennifer H Gay
(74) *Attorney, Agent, or Firm* — Baker Hughes Company

(57) ABSTRACT

A cutting element for an earth-boring tool includes a substrate and a volume of polycrystalline diamond on the substrate. The volume of polycrystalline diamond has exterior surfaces defining a front cutting surface, a peripheral edge, and at least a pair of angled tip surfaces defining at least one cutting tip between the pair of angled tip surfaces. The front cutting surface includes a first planar region and a second planar region, one or both of which may include a cutting tip. The front cutting surface may be characterized as generally concave. Earth-boring tools include a tool body and one or more such cutting elements secured to the tool body.

13 Claims, 14 Drawing Sheets

(56) References Cited

U.S. PATENT DOCUMENTS

| | | | | |
|---|---|---|---|---|
| 11,229,989 | B2 | 1/2022 | Bilen et al. | |
| 11,255,129 | B2 * | 2/2022 | Dubose | E21B 10/5676 |
| 11,391,095 | B2 * | 7/2022 | Tian | E21B 10/5676 |
| 11,598,153 | B2 * | 3/2023 | Graham | E21B 10/573 |
| 11,725,459 | B2 * | 8/2023 | Liu | E21B 10/5673 175/430 |
| 11,795,764 | B2 * | 10/2023 | Gan | E21B 10/55 |
| 11,873,684 | B2 * | 1/2024 | Zhao | E21B 10/5673 |
| 11,976,519 | B2 * | 5/2024 | Yu | E21B 10/5673 |
| 12,049,788 | B2 * | 7/2024 | Lovelace | E21B 10/5673 |
| 12,134,938 | B2 * | 11/2024 | Duffy | E21B 10/43 |
| 2018/0135355 | A1 | 5/2018 | DiGiovanni et al. | |
| 2019/0203539 | A1 * | 7/2019 | Zhao | E21B 10/5673 |
| 2019/0368277 | A1 * | 12/2019 | Zhao | C04B 37/021 |
| 2020/0157890 | A1 * | 5/2020 | Cuillier De Maindreville | E21B 10/5735 |
| 2020/0224500 | A1 * | 7/2020 | Dubose | E21B 10/5673 |
| 2020/0224501 | A1 * | 7/2020 | Dubose | E21B 10/5673 |
| 2020/0347680 | A1 * | 11/2020 | Tian | E21B 10/5673 |
| 2021/0164296 | A1 * | 6/2021 | Zhao | E21B 10/5676 |
| 2021/0172258 | A1 * | 6/2021 | Graham | E21B 10/55 |
| 2021/0277722 | A1 * | 9/2021 | Liu | E21B 10/5673 |
| 2021/0370419 | A1 * | 12/2021 | Yu | B23C 5/2213 |
| 2021/0381318 | A1 * | 12/2021 | Gan | E21B 10/5671 |
| 2022/0251905 | A1 * | 8/2022 | Duffy | E21B 10/5676 |
| 2022/0316280 | A1 * | 10/2022 | Doster | E21B 10/5676 |
| 2023/0151697 | A1 * | 5/2023 | Yu | E21B 10/5673 175/430 |
| 2023/0203892 | A1 | 6/2023 | Webb et al. | |
| 2023/0374866 | A1 * | 11/2023 | Rivera, Jr. | E21B 10/5673 |
| 2024/0011357 | A1 * | 1/2024 | Russell | E21B 10/55 |

OTHER PUBLICATIONS

International Written Opinion for Application No. PCT/US2023/080936 dated Mar. 22, 2024, 4 pages.

* cited by examiner

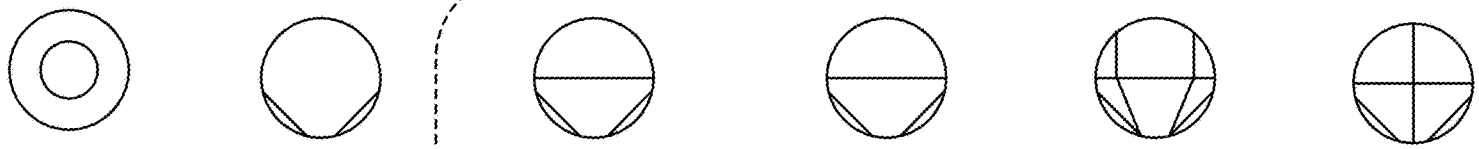

| Parameter | HFTO, Thumb | Neutral, Apex | PDC 50; Fig. 6 | PDC 60; Fig. 7 | PDC 70; Fig. 8 | PDC 80; Fig. 9 |
|---|---|---|---|---|---|---|
| Concave/ Convex | Convex | n/a | Concave | Concave | Concave | Concave |
| Face Tip Width | n/a | 0.173 | 0.173 | 0.100 | 0.100 | 0.080 |
| Face Tip Angle | n/a | 90° | 90° | 90° | 90° | 90° |
| Cutter Chamfer and Scoop Angle | 0.016 x 45° 0.050 x 20° | 0.016 x 45° Planar | 0.016 x 45° 0.052 x 10° | 0.016 x 45° 0.052 x 10° | 0.016 x 45° 0.052 x 10° | 0.016 x 45° 0.052 x 10° |
| Relief Taper | n/a | 6° | 6° | 10° | 10° | 10° |
| Plow Angle | n/a | n/a | n/a | n/a | 20° Outside Tip Width | 10° To Center |
| Leachable | Yes | No | No | No | No | No |
| # Repairs | 2 | 0 | 0 | 0 | 0 | 0 |
| Cutting Surfaces Finish | Polished | Polished | Lasered | Lasered | Lasered | Lasered |

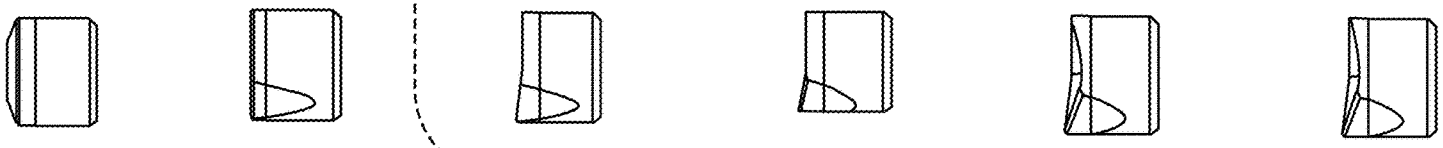

FIG. 14

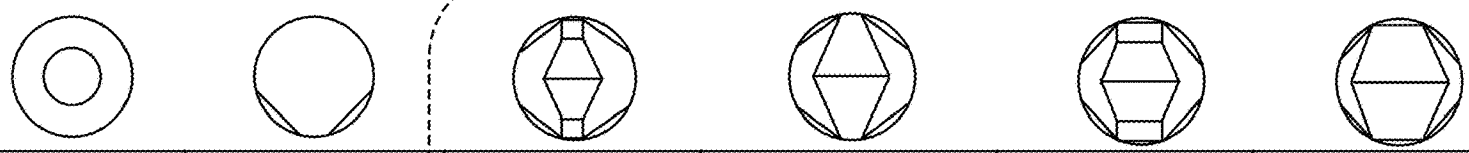

| Parameter | HFTO, Thumb | Neutral, Apex | PDC 90; Fig. 10 | PDC 100; Fig. 11 | PDC 110; Fig. 12 | PDC 120; Fig. 13 |
|---|---|---|---|---|---|---|
| Concave/ Convex | Convex | n/a | Concave | Concave | Concave | Concave |
| Face Tip Width | n/a | 0.173 | 0.100 | 0.100 | 0.080 Each | 0.080 |
| Face Tip Angle | n/a | 90° | 90° | 90° | 90° - Dual Peaks | 90° - Dual Peaks |
| Cutter Chamfer and Scoop Angle | 0.016 x 45° 0.050 x 20° | 0.016 x 45° Planar | 0.016 x 45° 0.052 x 10° | 0.016 x 45° 0.052 x 10° | 0.016 x 45° 0.052 x 10° | 0.016 x 45° 0.052 x 10° |
| Relief Taper | n/a | 6° | 30° | 30° | 25° | 25° |
| Plow Angle | n/a | n/a | 20° Outside Tip Width | 20° Outside Tip Width | 25° Outside Tip Width | 25° Outside Tip Width |
| Leachable | Yes | No | Yes | Yes | Yes | Yes |
| # Repairs | 2 | 0 | 1 | 1 | 1 | 1 |
| Cutting Surfaces Finish | Polished | Polished | Polish and Laser Mix | Lasered | Polish and Laser Mix | Lasered |

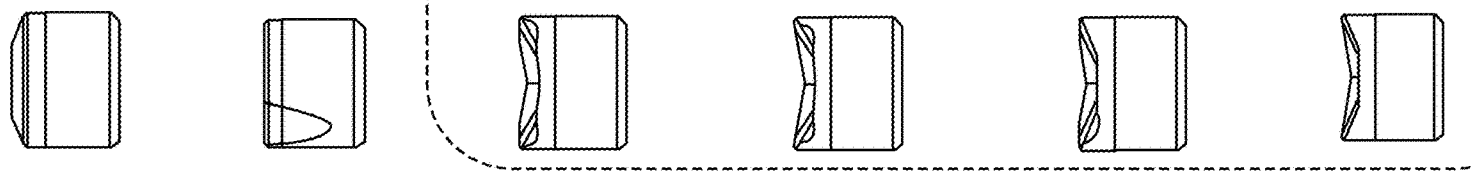

FIG. 15

CUTTING ELEMENTS AND GEOMETRIES FOR REDUCED VIBRATIONS, EARTH-BORING TOOLS, AND RELATED METHODS

CROSS-REFERENCE TO RELATED APPLICATION

This application claims the benefit under 35 U.S.C. § 119 (e) of U.S. Provisional Patent Application Ser. No. 63/384,709, filed Nov. 22, 2022, the disclosure of which is hereby incorporated herein in its entirety by this reference.

TECHNICAL FIELD

This disclosure relates generally to cutting elements for use on earth-boring tools during earth-boring operations. In particular, embodiments of the present disclosure relate to cutting elements having geometries for improved mechanical efficiency.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutting elements or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

The earth-boring rotary drill bit may be rotated within the wellbore by rotating the drill string from the surface of the formation, or the drill bit may be rotated by coupling the drill bit to a downhole motor, which is coupled to the drill string and disposed proximate the bottom of the wellbore. The downhole motor may include, for example, a hydraulic Moineau-type motor having a shaft, to which the earth-boring rotary drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Different types of earth-boring rotary drill bits are known in the art, including fixed-cutting element bits, rolling-cutting element bits, and hybrid bits (which may include, for example, both fixed cutting elements and rolling cutting elements). Fixed-cutting element bits, as opposed to roller cone bits, have no moving parts and are designed to be rotated about the longitudinal axis of the drill string. Most fixed-cutting element bits employ polycrystalline diamond compact (PDC) cutting elements. The cutting edge of a PDC cutting element drills rock formations by shearing, like the cutting action of a lathe, as opposed to roller cone bits that drill by indenting and crushing the rock. The cutting action of the cutting edge plays a major role in the amount of energy needed to drill a rock formation.

A PDC cutting element is usually composed of a thin layer, (e.g., about 0.3 mm to about 5 mm), of polycrystalline diamond bonded to a cutting element substrate at an interface. The polycrystalline diamond material is often referred to as the "diamond table." A PDC cutting element is generally cylindrical with a diameter from about 8 mm up to about 24 mm. However, PDC cutting elements may be available in other forms such as oval or triangle-shapes and may be larger or smaller than the sizes stated above.

A PDC cutting element may be fabricated separately from the bit body and secured within cutting element pockets formed in the outer surface of a blade of the bit body. A bonding material such as an adhesive or, more typically, a braze alloy may be used to secure the PDC cutting element by its supporting substrate within the pocket. The diamond table of a PDC cutting element is formed by sintering and bonding together relatively small diamond grains in a high-temperature, high-pressure (HTHP) sintering process. The sintering process is usually carried out in the presence of a catalyst material (such as, for example, cobalt, iron, nickel, or alloys and mixtures thereof) to form a layer or "table" of polycrystalline diamond material on the cutting element substrate.

BRIEF SUMMARY

In some embodiments, the present disclosure includes a cutting element for an earth-boring tool. The cutting element includes a substrate and a volume of polycrystalline diamond on the substrate. The volume of polycrystalline diamond has exterior surfaces defining a front cutting surface, a peripheral edge, and a pair of angled tip surfaces defining a cutting tip between the pair of angled tip surfaces. The front cutting surface includes a first planar region and a second planar region. The second planar region includes the cutting tip. The second planar region is oriented at an angle relative to the first planar region such that the front cutting surface is generally concave. The second planar region is oriented at an acute angle relative to relative-to-a plane perpendicular to a longitudinal axis of the cutting element.

According to advantageous features of the cutting element, taken alone or in any feasible combination:

- the cutting tip may extend to a height above the first planar region of the front cutting surface;
- the first planar region of the front cutting face may be oriented perpendicular to the longitudinal axis of the cutting element;
- the exterior surfaces of the volume of polycrystalline diamond may further define angled plow surfaces on opposite lateral sides of the cutting tip, and the angled plow surfaces may be disposed at an acute angle relative to a plane perpendicular to the longitudinal axis of the cutting element;
- the cutting tip may have a tip width in a range extending from 0.080 inch to 0.173 inch;
- the angled tip surfaces may be planar and oriented relative to one another at a tip angle of about 90°;
- the substrate may be cylindrical;
- the cutting tip may have dual cutting peaks;

the exterior surfaces of the volume of polycrystalline diamond may further define another pair of angled tip surfaces defining another cutting tip between the another pair of angled tip surfaces, the first planar region including the another cutting tip; and/or the cutting tip and the another cutting tip may each have dual cutting peaks.

In additional embodiments, the present disclosure includes a cutting element for an earth-boring tool, the cutting element including a substrate and a volume of polycrystalline diamond on the substrate. The volume of polycrystalline diamond has exterior surfaces defining a front cutting surface, a peripheral edge, and angled tip surfaces defining a cutting tip between the angled tip surfaces. The front cutting surface includes an upper left plow surface, an upper right plow surface, a lower left plow surface, and a lower right plow surface. The lower left and right plow surfaces include the cutting tip. A first ridgeline at an intersection between the lower left plow surface and the lower right plow surface is oriented at an acute angle relative to a plane perpendicular to the longitudinal axis of the cutting element. The cutting tip extends a height above a second ridgeline at an intersection between the upper left plow surface and the upper right plow surface.

According to advantageous features of the cutting element, taken alone or in any feasible combination:

the second ridgeline may be perpendicular to the longitudinal axis of the cutting element;

the angled tip surfaces may be planar and oriented at an acute angle relative to a line tangent to a side surface of the cutting element;

The upper left plow surface and the upper right plow surface each may be oriented at an acute angle of 10° relative to a plane perpendicular to the longitudinal axis of the cutting element;

the cutting tip may have a tip width in a range extending from 0.080 inch to 0.173 inch; and/or the angled tip surfaces may be planar and oriented relative to one another at a tip angle of about 90°.

In additional embodiments of the present disclosure, a cutting element for an earth-boring tool includes a substrate and a volume of polycrystalline diamond on the substrate. The volume of polycrystalline diamond has exterior surfaces defining a front cutting surface, a peripheral edge, and a pair of angled tip surfaces defining a cutting tip between the pair of angled tip surfaces. The front cutting surface includes a first planar region and a second planar region. The second planar region is oriented at an angle relative to the first planar region such that the front cutting surface is generally concave. The second planar region is oriented at an acute angle relative to relative to a plane perpendicular to a longitudinal axis of the cutting element. The front cutting surface further includes a planar face region at the cutting tip, and the planar face region is oriented perpendicular to the longitudinal axis of the cutting element.

According to advantageous features of the cutting element, taken alone or in any feasible combination:

the cutting tip may have dual cutting peaks;

the exterior surfaces of the volume of polycrystalline diamond may further define another pair of angled tip surfaces defining another cutting tip between the another pair of angled tip surfaces, and the front cutting surface may further include another planar face region at the another cutting tip, the another planar face region oriented perpendicular to the longitudinal axis of the cutting element; and/or the cutting tip and the another cutting tip each may have dual cutting peaks.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein:

FIG. 14 is a diagram that includes a table listing certain characteristics and features of the cutting elements of FIGS. 6-9 relative to two other geometries of cutting elements;

FIG. 15 is a diagram like that of FIG. 14 and includes a table listing certain characteristics and features of the cutting elements of FIGS. 10-13 relative to the same two other geometries of cutting elements;

DETAILED DESCRIPTION

Figure 1:
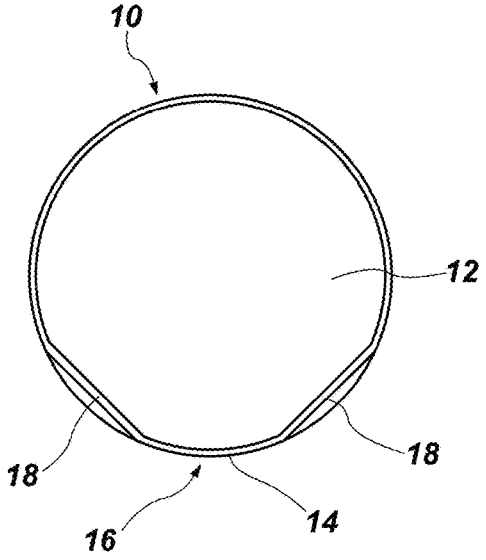
FIG. 1 is a front plan view of a cutting element in accordance with embodiments of the present disclosure, and is labeled to illustrate a tip angle and a tip width of the cutting element.

The illustrations presented herein are not actual views of any cutting element or earth-boring tool, or any component thereof, but are merely idealized representations, which are employed to describe embodiments of the present invention.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any cutting element or earth-boring tool when utilized in a conventional manner. Furthermore, these terms may refer to an orientation of elements of any cutting element or earth-boring tool as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "inter-granular bond" means and includes any direct atomic bond (e.g., covalent, metallic, etc.) between atoms in adjacent grains of material.

As used herein, the term "catalyst material" refers to any material that is capable of catalyzing the formation of inter-granular bonds between grains of hard material during a sintering process (e.g., a high-temperature, high-pressure (HTHP) sintering process). For example, catalyst materials for diamond include, but are not limited to, cobalt, iron, nickel, other elements from Group VIII-A of the periodic table of the elements, and alloys thereof.

As used herein, the term "hard material" means and includes any material having a Knoop hardness value of about 3,000 $Kg_f/mm^2$ (29,420 MPa) or more. Hard materials include, for example, diamond and cubic boron nitride.

Embodiments of the present disclosure include cutting elements having shapes and geometries that can be employed to reduce the likelihood or eliminate the initiation of damaging vibrations and frequencies that can occur during the drilling process.

Field and lab testing has shown that cutters with features that are typically associated with aggressiveness tend to lead to better torsional stability compared to using a standard planar cutting element. The unique shapes in the present disclosure incorporate sharper "V" type cutting edges, various horizontal and vertical plow angles, concavity, and designs with dual-peak cutting edges. The designs enhance features that may lead to improved vibration-mitigation when drilling. These novel cutting element shapes help to reduce or eliminate the likelihood of initiating damaging vibrations during the drilling process. Damaging vibrations can ultimately lead to increased wear and tear on the tools, poor drilling performance, and/or complete tool failure in some cases. The more aggressive cutting element shapes in the present disclosure may require less weight-on-bit to drill and effectively reduce the risk of damaging torsional vibrations and stick-slip when drilling at higher weight-on-bit (WOB). The cutting element shapes can also help in situations where drilling rigs are capable of applying only limited weight and/or torque, due to the more aggressive cutting features and geometries of the cutting elements.

The cutting element geometries of the present disclosure assist in the reduction and/or elimination of damaging vibrations all while maintaining good rate-of-penetration (ROP) performance and durability at lower WOB. Finite element simulations on the cutting element geometries have shown comparable stress levels to currently known cutting element designs, with an expected improvement in vibration mitigation due to parameters that also influence aggressiveness.

Cutting elements of the present disclosure may have a generally cylindrical shape, but with an apex or tip at a location on the peripheral edge of the cutting element intended to contact the formation during drilling. For example, referring to FIG. 1, a cutting element 10 according to the present disclosure has a front cutting face 12, which may be planar or non-planar. A peripheral edge 14 of the front cutting surface 22 may be generally cylindrical. The cutting element 10, however, may include an apex or tip 16 defined between angled tip surfaces 18, which are generally oriented at an angle relative to a line extending between a centerpoint of the cutting element on the front cutting face 12 and the center of the tip 16 on the peripheral edge 14.

Figure 3:
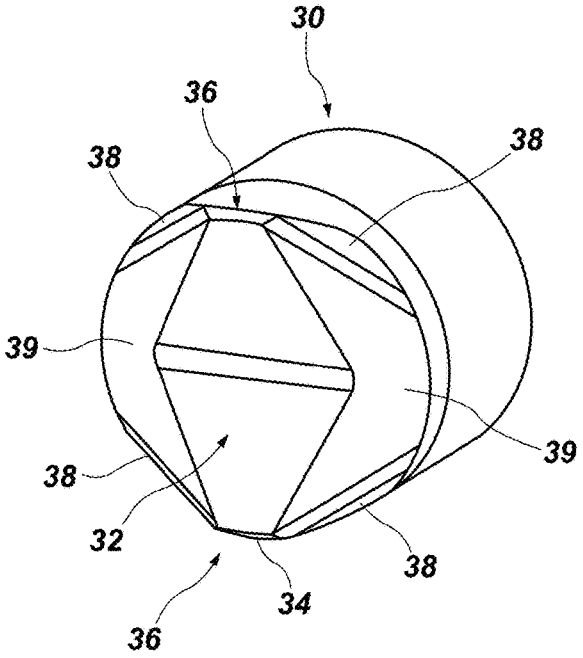
FIG. 3 is a perspective view of a cutting element in accordance with embodiments of the present disclosure, and illustrates a plow angle of the cutting element.
Figure 4:
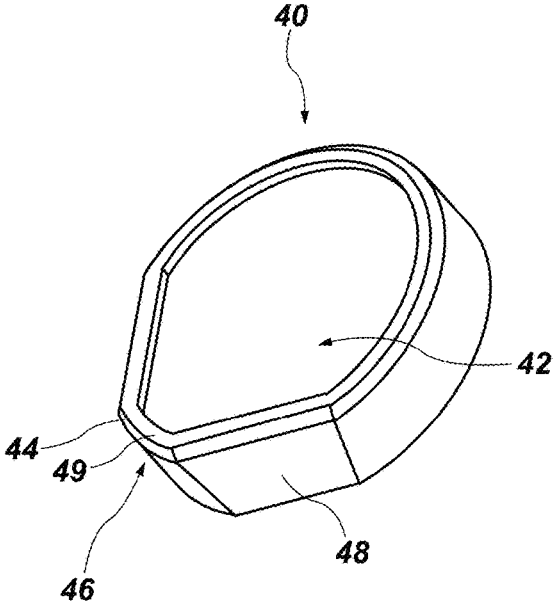
FIG. 4 is a perspective view of a cutting element in accordance with embodiments of the present disclosure, and illustrates a front cutting surface of the cutting element having a brim geometry, and is labeled to illustrate a brim depth, a brim width, and a brim inner angle of the brim geometry.
Figure 5:
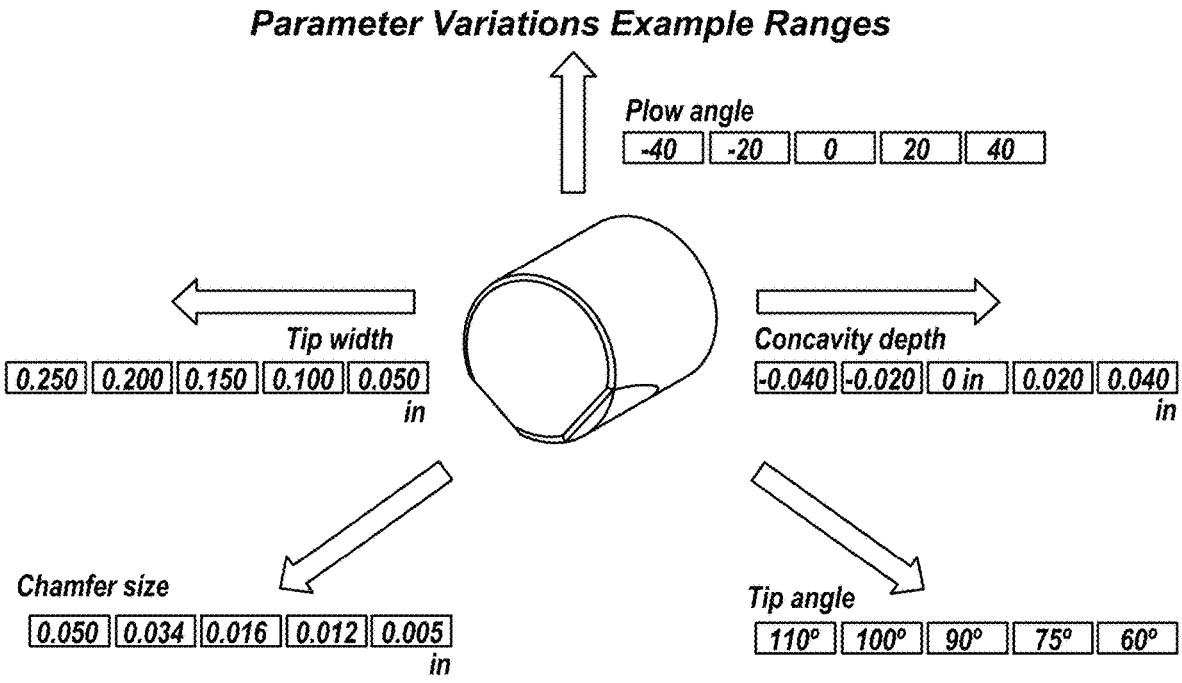
FIG. 5 is a diagram illustrating example parameter ranges for certain characteristics including plow angle, tip width, tip angle, concavity depth, and chamfer size, that may be exhibited by features of embodiments of cutting elements of the present disclosure.

FIGS. 1-4 illustrate various characteristics and features that may be incorporated into embodiments of cutting elements of the present disclosure, and FIG. 5 is a diagram illustrating non-limiting examples of parameter ranges that may be exhibited by cutting elements of the present disclosure in relation to those characteristics and features.

For example, as shown in FIG. 1, cutting elements of the present disclosure may be provided with a "tip width," which may be defined as the shortest linear distance between the two angled tip surfaces 18 between which the tip 16 is defined, as measured on the peripheral edge 14. Cutting elements of the present disclosure may be provided with a "tip angle," which may be defined as the smallest angle between the two angled tip surfaces 18 between which the tip 16 is defined on the peripheral edge 14, as measured in a plane perpendicular to a longitudinal axis of the cutting element. As shown in FIG. 5, the tip width may be between about 0.050 inches and about 0.250 inches, or even between about 0.100 inches and about 0.200 inches (e.g., about 0.150 inches), and the tip angle may be between about 60° and about 110°, or even between about 75° and about 100° (e.g., about 90°).

Figure 2:
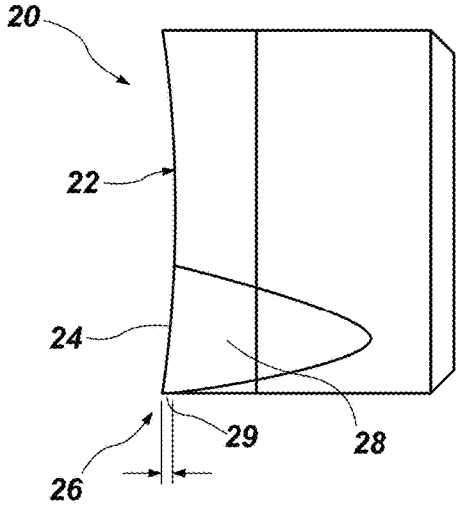
FIG. 2 is a side view of a cutting element in accordance with embodiments of the present disclosure, and is labeled to illustrate a concavity of a front cutting surface of the cutting element.

FIG. 2 is a side view of another cutting element 20 having a front cutting surface 22, a peripheral edge 24, and a tip 26 defined between angled tip surfaces 28. As shown in FIG. 2, cutting elements of the present disclosure may be provided with a non-planar front cutting surface 22. The cutting element 20 of FIG. 2 has a front cutting surface 22 that is concave, which results in a "concavity depth" having a positive value. As illustrated in FIG. 2, the concavity depth may be measured as the largest distance between the front cutting surface 22 and a plane perpendicular to the longitudinal axis of the cutting element 20 and intersecting the peripheral edge 24 at the tip 26. In embodiments in which the front cutting surface 22 is convex, the concavity depth would be a negative value. As shown in FIG. 5, the concavity depth may be between about −0.138 inches and about 0.136 inches, between about −0.060 inches and about 0.060 inches, between about −0.040 inches and about 0.040 inches, or even between about −0.020 inches and about 0.020 inches. In embodiments in which the front cutting surface 22 is flat, the concavity depth would be zero inches.

As is also shown in FIG. 2, embodiments of cutting elements of the present disclosure also may include one or more chamfer surfaces 29 at the peripheral edge 24 of the front cutting face 12 thereof. The chamfer surface 29 may be oriented at a chamfer angle relative to the longitudinal axis of the cutting element, and may have a chamfer size, which may be defined as the shortest linear distance across the chamfer surface 29 at the tip 26. As shown in FIG. 5, the chamfer size may be between about 0.005 inches and about 0.050 inches, or even between about 0.012 inches and about 0.034 inches (e.g., about 0.016 inches). Furthermore, the chamfer surface 29 may be oriented at a chamfer angle of from about 10° to about 80° relative to the longitudinal axis of the cutting element.

FIG. 3 is a perspective view of another cutting element 30 having a front cutting surface 32, a peripheral edge 34, and a tip 36 defined between angled tip surfaces 38 as previously described with reference to FIGS. 1 and 2. As shown in FIG. 3, cutting elements of the present disclosure may further include angled "plow" surfaces 39 on opposing lateral sides of the cutting element 30. The angled plow surfaces 39 may be oriented and configured to facilitate plowing of the cutting element through the formation near the tip 36, and through cuttings removed from the formation by the tip 36 during drilling. As shown in FIG. 3, the cutting element 30 has two angled plow surfaces 39 oriented at an angle relative to a plane perpendicular to the longitudinal axis of the cutting element 30. This "plow angle" is an acute angle. As shown in FIG. 5, the plow angle of each angled plow surface 39 may be independently chosen to be between about −40° and about 40°, or even between about −20° and 20°.

FIG. 4 is a perspective view of another cutting element 40 having a front cutting surface 42, a peripheral edge 44, and a tip 46 defined between angled surfaces 48 as previously described herein. The cutting element of FIG. 4 has a brim geometry. In particular, the front cutting surface 42 has a central recess so as to define a protruding brim 49 extending around the periphery of the cutting element 40. The brim 49 may have a brim width, and a brim depth, as illustrated in FIG. 4. The brim width may be between about 0.020 inches and about 0.500 inches, or even between about 0.100 inches and about 0.250 inches. The brim depth may be between about 0.020 inches and about 0.200 inches, or even between about 0.050 inches and about 0.100 inches. Furthermore, the inside surface of the brim 49 may be oriented at a "brim inner angle" relative to the front cutting surface 42, as shown in FIG. 4. The brim inner angle may be between about 80° and about 160°, between about 90° and about 140°, or even between about 100° and about 120°.

Cutting elements having brim geometries and cutting elements having concave surfaces may provide similar advantages in terms of cutting performance, and may be alternative solutions for similar problems associated with insufficient evacuation of cuttings during drilling and resulting bit balling, vibrations, etc.

FIGS. 6-13 illustrate various PDC cutting elements according to the present disclosure, each including a volume of polycrystalline diamond on a cemented tungsten carbide substrate, for example, and FIGS. 14 and 15 are diagrams illustrating parameter values for different features and characteristics of the PDC cutting elements of FIGS. 6-9 and FIGS. 10-13, respectively, relative to those parameter values for two other cutting elements.

Figure 6:
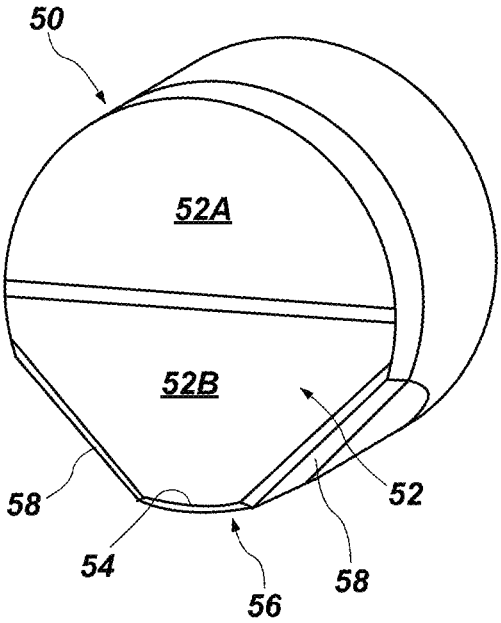
FIG. 6 is a perspective view of an embodiment of a cutting element of the present disclosure.

FIG. 6 is a perspective view of another cutting element 50 having a front cutting surface 52, a peripheral edge 54, and a tip 56 defined between angled tip surfaces 58 as previously described herein. The cutting element 50 of FIG. 6 has a front cutting surface 52 that includes two planar regions 52A and 52B. The upper planar region 52A, which does not include any portion of the tip 56, is oriented perpendicular to the longitudinal axis of the cutting element 50. The lower planar region 52B, which does include a portion of the tip 56, is oriented at an angle relative to the upper planar region 52A, so as to give the front cutting surface 52 a generally concave shape. As shown in the table of FIG. 14, the cutting element 50 of FIG. 6 is concave, and the lower planar region 52B is oriented at an acute angle of 10° (referred to in FIG. 14 as the "scoop angle") relative to a plane perpendicular to the longitudinal axis of the cutting element 50 (and the upper planar region 52B), which, for a cutting element 50 having a diameter of 0.625 inches, results in the tip 56 extending a height of 0.052 inches above the upper planar region 52A. The cutting element 50 has a face tip width of 0.173 inches, and a face tip angle of 90°. The tip 56 has a chamfer surface at the cutting edge of the tip 56, and the chamfer surface is oriented at an angle of 45° to the plane perpendicular to the longitudinal axis of the cutting element, and the chamfer height of the chamfer surface is 0.016 inches, as measured from the plane perpendicular to the longitudinal axis. The tip 56 is defined by the angled tip surfaces 58, which are planar and oriented at an angle (referred to in FIG. 14 as the "relief taper") of 6° relative to a line tangent to the cylindrical side surface of the cutting element 50. The cutting element 50 of FIG. 6 does not include angled plow surfaces.

The cutting element 50 of FIG. 6 could also include a brim geometry on the lower planar region 52B. The brim could have a width and depth each of 0.050". The top and bottom edges of the brim (the side surfaces of the brim) could have a 0.016" chamfer surface oriented at a 45° angle, for example.

Figure 7:
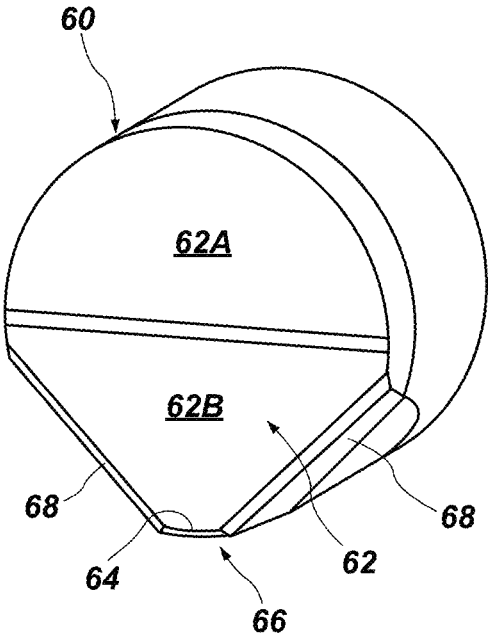
FIG. 7 is a perspective view of an embodiment of a cutting element of the present disclosure.

FIG. 7 is a perspective view of another cutting element 60 having a front cutting surface 62, a peripheral edge 64, and a tip 66 defined between angled tip surfaces 68 as previously described herein. The cutting element 60 of FIG. 7 has a front cutting surface 62 that includes two planar regions 62A and 62B. The upper planar region 62A, which does not include any portion of the tip 66, is oriented perpendicular to the longitudinal axis of the cutting element 60. The lower planar region 62B, which does include a portion of the tip 66, is oriented at an angle relative to the upper planar region 62A, so as to give the front cutting surface 62 a generally concave shape. As shown in the table of FIG. 14, the cutting element 60 of FIG. 7 is concave, and the lower planar region 62B is oriented at an acute angle of 10° (referred to in FIG. 14 as the "scoop angle") relative to a plane perpendicular to the longitudinal axis of the cutting element 60 (and to the upper planar region 62A), which, for a cutting element 60 having a diameter of 0.625 inches, results in the tip 66 extending a height of 0.052 inches above the upper planar region 62A. The cutting element 60 has a face tip width of 0.100 inches, and a face tip angle of 90°. The tip 66 has a chamfer surface at the cutting edge of the tip 66, and the chamfer surface is oriented at an angle of 45° to the plane perpendicular to the longitudinal axis of the cutting element, and the chamfer height of the chamfer surface is 0.016 inches, as measured from the plane perpendicular to the longitudinal axis. The tip 66 is defined by the angled tip surfaces 68, which are planar and oriented at an angle (referred to in FIG. 14 as the "relief taper") of 10° relative to a line tangent to the cylindrical side surface of the cutting element 60. The higher relief taper angle of 10° of the cutting element 60 of FIG. 7 relative to the lower relief taper angle of 6° of the cutting element 50 of FIG. 6 results in the cutting element 60 having a smaller tip width than the cutting element 50. The cutting element 60 of FIG. 7 does not include angled plow surfaces.

Figure 8:
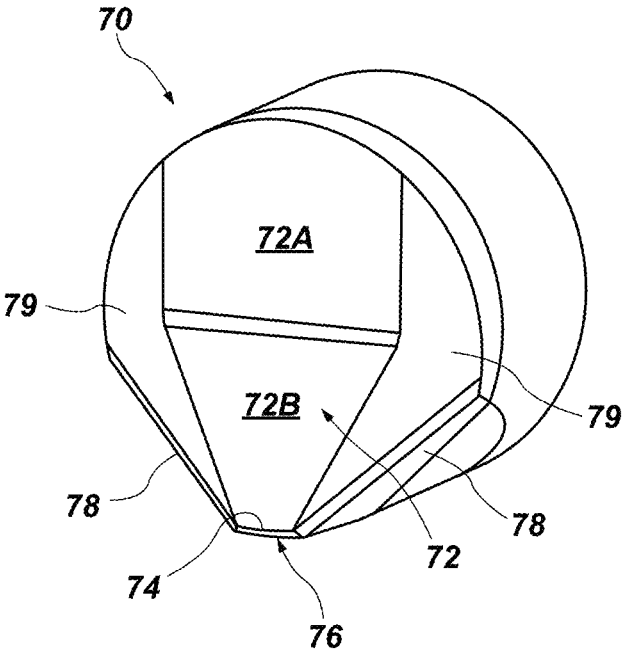
FIG. 8 is a perspective view of an embodiment of a cutting element of the present disclosure.

FIG. 8 is a perspective view of another cutting element 70 having a front cutting surface 72, a peripheral edge 74, and a tip 76 defined between angled tip surfaces 78 as previously described herein. The cutting element 70 also includes angled plow surfaces 79. The cutting element 70 of FIG. 8 has a front cutting surface 72 that includes two planar regions 72A and 72B. The upper planar region 72A, which does not include any portion of the tip 76, is oriented perpendicular to the longitudinal axis of the cutting element 70. The lower planar region 72B, which does include the tip 76, is oriented at an angle relative to the upper planar region 72A, so as to give the front cutting surface 72 a generally concave shape. As shown in the table of FIG. 14, the cutting element 70 of FIG. 8 is concave, and the lower planar region 72B is oriented at an acute angle of 10° (referred to in FIG. 14 as the "scoop angle") relative to the plane perpendicular to the longitudinal axis of the cutting element 70 (and to the upper planar region 62B), which, for a cutting element 70 having a diameter of 0.625 inches, results in the tip 76 extending a height of 0.052 inches above the upper planar region 72A. The cutting element 70 has a face tip width of 0.100 inches, and a face tip angle of 90°. The tip 76 has a chamfer surface at the cutting edge of the tip 76, and the chamfer surface is oriented at an angle of 45° to the plane perpendicular to the longitudinal axis of the cutting element 70, and the chamfer height of the chamfer surface is 0.016 inches, as measured from the plane perpendicular to the longitudinal axis. The tip 76 is defined by the angled tip surfaces 78, which are planar and oriented at an angle (referred to in FIG. 14 as the "relief taper") of 10° relative to a line tangent to the cylindrical side surface of the cutting element 70. The cutting element 70 of FIG. 8 further includes angled plow surfaces 79, which are oriented at an angle of 20° relative to a plane perpendicular to the longitudinal axis of the cutting element 70 (outside the tip width).

Figure 9:
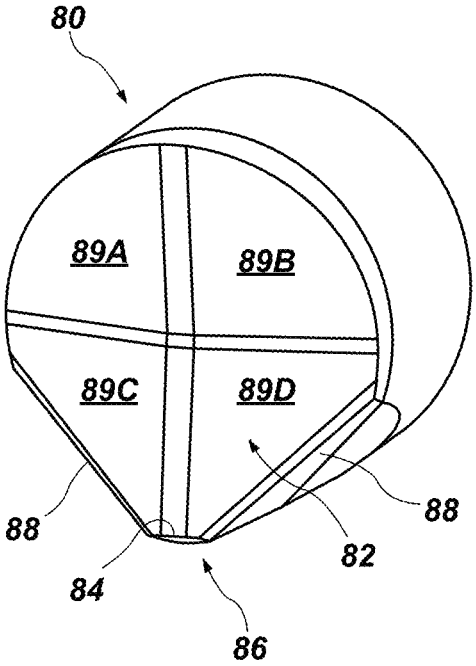
FIG. 9 is a perspective view of an embodiment of a cutting element of the present disclosure.

FIG. 9 is a perspective view of another cutting element 80 having a front cutting surface 82, a peripheral edge 84, and a tip 86 defined between angled tip surfaces 88 as previously described herein. The front cutting surfaces 82 is defined by and comprises four angled plow surfaces 89A-89D, which include upper left and right angled plow surfaces 89A and 89B, and lower left and right angled plow surfaces 89C and 89D. The lower angled plow surfaces 89C and 89D are oriented at angles relative to the upper angled plow surfaces 89A and 89B so as to render the front cutting surface 82 concave. The lower plow surfaces 89A and 89B include the tip 86. As shown in the table of FIG. 14, the cutting element 80 of FIG. 9 is concave, and the ridgeline at the intersection between the lower angled plow surfaces 89A and 89B is oriented at an acute angle of 10° (referred to in FIG. 14 as the "scoop angle") relative to the plane perpendicular to the longitudinal axis of the cutting element 80 (and to ridgeline at the intersection between the upper angled plow surfaces 89C and 89D), which, for a cutting element 80 having a diameter of 0.625 inches, results in the tip 86 extending a height of 0.052 inches above the ridgeline at the intersection between the upper angled plow surfaces 89C and 89D. The cutting element 80 has a face tip width of 0.080 inches, and a face tip angle of 90°. The tip 86 has a chamfer surface at the cutting edge of the tip 86, and the chamfer surface is oriented at an angle of 45° to the plane perpendicular to the longitudinal axis of the cutting element 80, and the chamfer height of the chamfer surface is 0.016 inches, as measured from the plane perpendicular to the longitudinal axis. The tip 86 is defined by the angled tip surfaces 88, which are planar and oriented at an angle (referred to in FIG. 14 as the "relief taper") of 10° relative to a line tangent to the cylindrical side surface of the cutting element 80. The upper angled plow surfaces 89C and 89D are oriented at an angle of 10° relative to the plane perpendicular to the longitudinal axis of the cutting element 80 up to the ridgeline at the intersection between the upper angled plow surfaces 89C and 89D.

Figure 10:
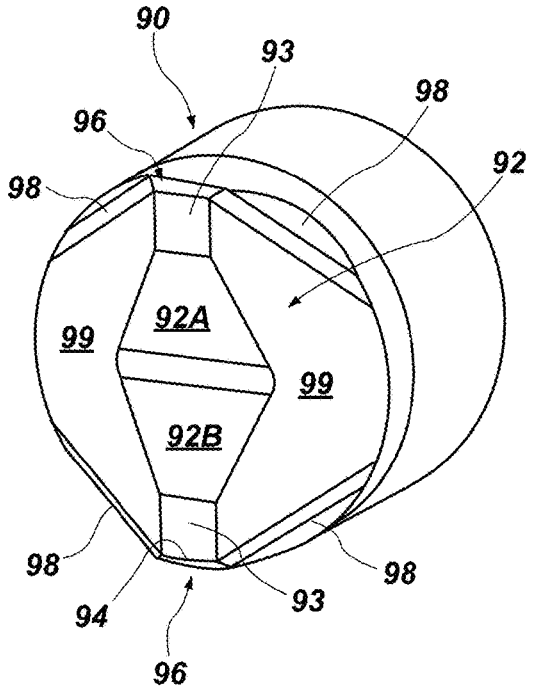
FIG. 10 is a perspective view of an embodiment of a cutting element of the present disclosure.

FIG. 10 is a perspective view of another cutting element 90 having a front cutting surface 92, a peripheral edge 94, a tip 96 defined between angled surfaces 98 as previously described herein, and angled plow surfaces 99. The cutting element of FIG. 10 has a front cutting surface 92 that includes two symmetrical planar regions 92A and 92B extending between two tips 96. The upper planar region 92A and the lower planar region 92B are oriented at an angle relative to one another so as to give the front cutting surface 92 a generally concave shape. As shown in the table of FIG. 15, the cutting element 90 of FIG. 10 is concave, and the upper planar region 92A and the lower planar region 92B are each oriented at an acute angle of 10° (referred to in FIG. 15 as the "scoop angle") relative to a plane perpendicular to the longitudinal axis of the cutting element 90, which, for a cutting element 90 having a diameter of 0.625 inches, results in each tip 96 extending a height of 0.052 inches above the line of intersection between the regions 92A and 92B. The tips 96 of cutting element 90 have a face tip width of 0.100 inches, and a face tip angle of 90°. Each tip 96 has a chamfer surface at the cutting edge of the tip 96, and the chamfer surface is oriented at an angle of 45° to the plane perpendicular to the longitudinal axis of the cutting element 90, and the chamfer height of the chamfer surface is 0.016 inches, as measured from the plane perpendicular to the longitudinal axis. Each tip 96 is defined by angled tip surfaces 98, which are planar and oriented at an angle (referred to in FIG. 15 as the "relief taper") of 30° relative to a line tangent to the cylindrical side surface of the cutting element 90. The front cutting surface 92 further comprises a planar face region 93 at each of the tips 96, and the planar face regions 93 are oriented perpendicular to the longitudinal axis of the cutting element 90. The cutting element 90 of FIG. 10 includes angled plow surfaces 99, each of which is oriented at a plow angle of 20° relative to a plane perpendicular to the longitudinal axis of the cutting element 90 (outside the tip width).

Figure 11:
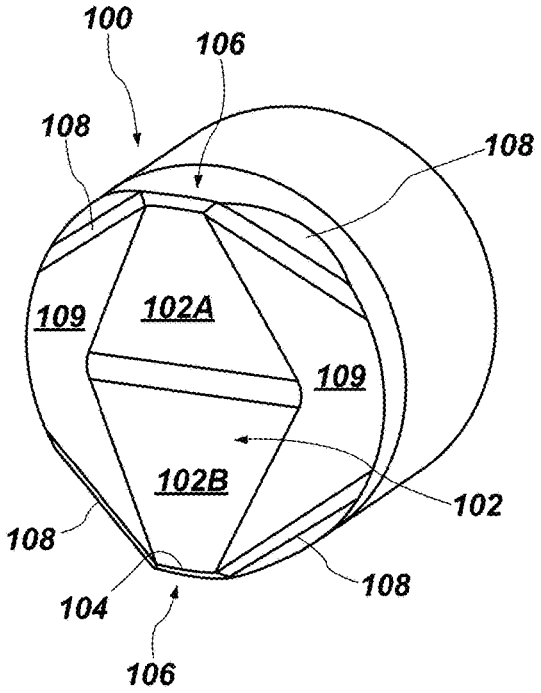
FIG. 11 is a perspective view of an embodiment of a cutting element of the present disclosure.

FIG. 11 is a perspective view of another cutting element 100 having a front cutting surface 102, a peripheral edge 104, and a tip 106 defined between angled tip surfaces 108 as previously described herein. The cutting element 100 also has angled plow surfaces 109. The cutting element 100 of FIG. 11 has a front cutting surface 102 that includes two symmetrical planar regions 102A and 102B, each having a tip 106. The upper planar region 102A and the lower planar region 102B are oriented at an angle relative to one another so as to give the front cutting surface 102 a generally concave shape. As shown in the table of FIG. 15, the cutting element 100 of FIG. 11 is concave, and the upper planar region 102A and the lower planar region 102B are each oriented at an acute angle of 10° (referred to in FIG. 15 as the "scoop angle") relative to a plane perpendicular to the longitudinal axis of the cutting element 100, which, for a cutting element 100 having a diameter of 0.625 inches, results in each tip 106 extending a height of 0.052 inches above the line of intersection between the regions 102A and 102B. The tips 106 of cutting element 100 have a face tip width of 0.100 inches, and a face tip angle of 90°. Each tip 106 has a chamfer surface at the cutting edge of the tip 106, and the chamfer surface is oriented at an angle of 45° to the plane perpendicular to the longitudinal axis of the cutting element 100, and the chamfer height of the chamfer surface is 0.016 inches, as measured from the plane perpendicular to the longitudinal axis. Each tip 106 is defined by the adjacent angled tip surfaces 108, which are planar and oriented at an angle (referred to in FIG. 15 as the "relief taper") of 30° relative to a line tangent to the cylindrical side surface of the cutting element 100. The cutting element 100 of FIG. 11 includes angled plow surfaces 109, each of which is oriented at a plow angle of 20° relative to a plane perpendicular to the longitudinal axis of the cutting element 100 (outside the tip width).

Figure 12:
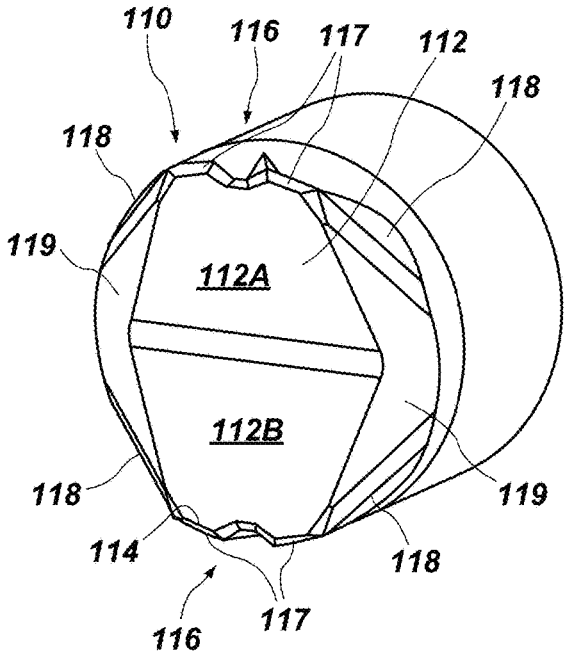
FIG. 12 is a perspective view of an embodiment of a cutting element of the present disclosure.

FIG. 12 is a perspective view of another cutting element 110 having a front cutting surface 112, a peripheral edge 114, and a tips 116 defined between angled surfaces 118 as previously described herein. The tips 116 have dual cutting peaks 117, as described in further detail below. The cutting element 110 also has angled plow surfaces 119. The cutting element 110 of FIG. 12 has a front cutting surface 112 that includes two symmetrical planar regions 112A and 112B, each having a tip 116 with dual cutting edges or peaks. The upper planar region 112A and the lower planar region 112B are oriented at an angle relative to one another so as to give the front cutting surface 112 a generally concave shape. As shown in the table of FIG. 15, the cutting element 110 of FIG. 12 is concave, and the upper planar region 112A and the lower planar region 112B are each oriented at an acute angle of 10° (referred to in FIG. 15 as the "scoop angle") relative to a plane perpendicular to the longitudinal axis of the cutting element 110, which, for a cutting element 110 having a diameter of 0.625 inches, results in each tip 116 extending a height of 0.052 inches above the line of intersection between the regions 112A and 112B. Each of the tips 116 of cutting element 110 has dual cutting peaks 117, each having a cutting edge thereon. Each of the dual cutting peaks 117 has a face tip width of 0.080 inches, and each of the dual cutting peaks 117 has a face tip angle of 90°. Each tip 116 has a chamfer surface at the cutting edge of the tip 116, and the chamfer surface is oriented at an angle of 45° to the plane perpendicular to the longitudinal axis of the cutting element 110, and the chamfer height of the chamfer surface is 0.016 inches, as measured from the plane perpendicular to the longitudinal axis. Each tip 116 is defined by the adjacent angled tip surfaces 118, which are planar and oriented at an angle (referred to in FIG. 15 as the "relief taper") of 25° relative to a line tangent to the cylindrical side surface of the cutting element 110. The cutting element 110 of FIG. 12 includes angled plow surfaces 119, each of which is oriented at a plow angle of 25° relative to a plane perpendicular to the longitudinal axis of the cutting element 110 (outside the tip width).

Figure 13:
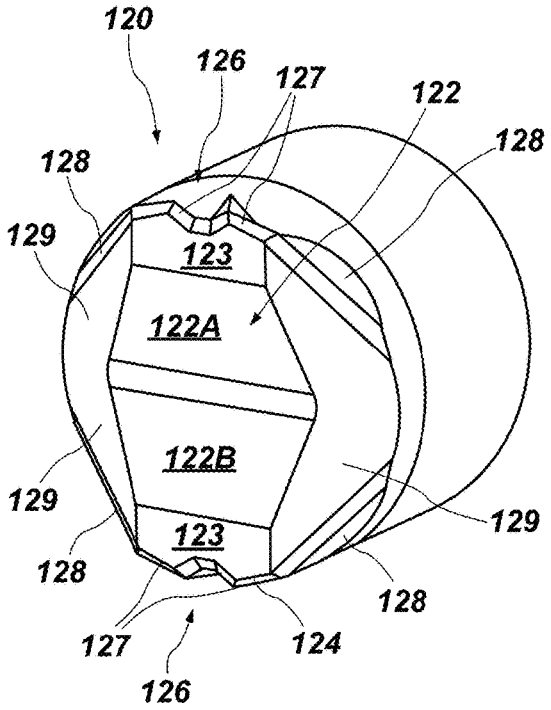
FIG. 13 is a perspective view of an embodiment of a cutting element of the present disclosure.

FIG. 13 is a perspective view of another cutting element 120 having a front cutting surface 122, a peripheral edge 124, and tips 126 defined between angled surfaces 128 as previously described herein. The tips 126 have dual cutting peaks 127, as described in further detail below. The cutting element 120 also has angled plow surfaces 129. The cutting element 120 of FIG. 13 has a front cutting surface 122 that includes two symmetrical planar regions 122A and 122B, each extending toward a tip 126. The upper planar region 122A and the lower planar region 122B are oriented at an angle relative to one another so as to give the front cutting surface 122 a generally concave shape. As shown in the table of FIG. 15, the cutting element 120 of FIG. 13 is concave, and the upper planar region 122A and the lower planar region 122B are each oriented at an acute angle of 10° (referred to in FIG. 15 as the "scoop angle") relative to a plane perpendicular to the longitudinal axis of the cutting element 120, which, for a cutting element 120 having a diameter of 0.625 inches, results in each tip 126 extending a height of 0.052 inches above the line of intersection between the regions 122A and 122B. Each of the tips 126 of cutting element 120 has dual cutting peaks 127, each having a cutting edge thereon. Each of the dual cutting peaks 127 has a face tip width of 0.080 inches, and each of the dual cutting peaks 127 has a face tip angle of 90°. Each tip 126 has a chamfer surface at the cutting edge of the tip 126, and the chamfer surface is oriented at an angle of 45° to the plane perpendicular to the longitudinal axis of the cutting element 120, and the chamfer height of the chamfer surface is 0.016 inches, as measured from the plane perpendicular to the longitudinal axis. Each tip 126 is defined by the adjacent angled tip surfaces 128, which are planar and oriented at an angle (referred to in FIG. 15 as the "relief taper") of 25° relative to a line tangent to the cylindrical side surface of the cutting element 120. The front cutting surface 122 further comprises a planar face region 123 at each of the tips 126, and the planar face regions 123 are oriented perpendicular to the longitudinal axis of the cutting element 130. The cutting element 120 of FIG. 13 includes angled plow surfaces 129, each of which is oriented at a plow angle of 25° relative to a plane perpendicular to the longitudinal axis of the cutting element 120 (outside the tip width).

Expanding the length of drilling sections from shoe-to-shoe requires drilling high depth-of-cut sections efficiently while maintaining durability in lower transitions. FIGS. 16-26 illustrate various embodiments of cutting elements of the present disclosure that have novel cutting surface geometries designed and configured to help generate multiple cracks across an area of cut.

The geometries allow these cutting elements to behave differently at different depths-of-cut (DOC). The geometries render the cutting elements durable and efficient at low depth-of-cut, provide point loading, and may have polished surfaces for efficiency in sticky shale formations. The cutting elements also may have recessed surfaces at high DOC to lower a weight requirement.

Figure 16:
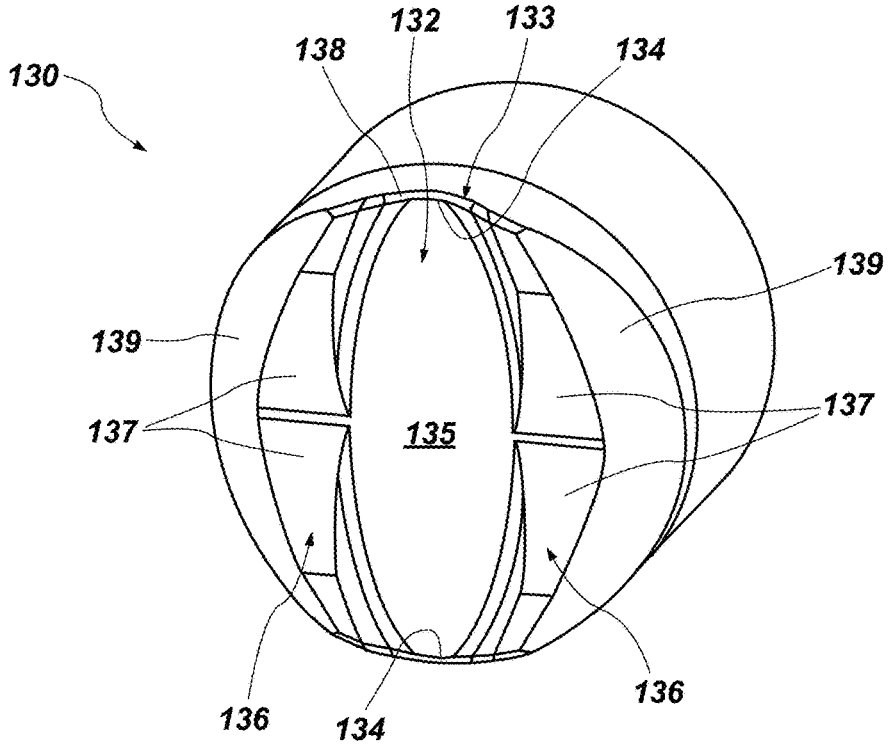
FIG. 16 is a perspective view of an embodiment of a cutting element of the present disclosure.

FIG. 16 illustrates a cutting element 130 having a front cutting surface 132. The front cutting surface 132 is symmetric along a horizontal centerline between two cutting tips 133, each having a peripheral cutting edge 134. The front cutting face 132 has a central recess 135. The region of the front cutting surface 132 within the central recess 135 may be substantially planar and oriented perpendicular to the longitudinal axis of the cutting element 130, the shape of which recess 135 may be characterized as generally elliptical. On each lateral side of the central recess 135 is a generally concave ridge 136. Each ridge 136 may comprise inclined surfaces 137, which may be planar or curved, so as to provide each ridge 136 with a generally concave geometry. The cutting edge 134 of the cutting tips 133 may comprise a chamfer surface 138 as previously described herein. The cutting element 130 of FIG. 16 further includes angled plow surfaces 139, each of which may be oriented at a plow angle relative to a plane perpendicular to the longitudinal axis of the cutting element 130 as previously described herein.

Figure 17:
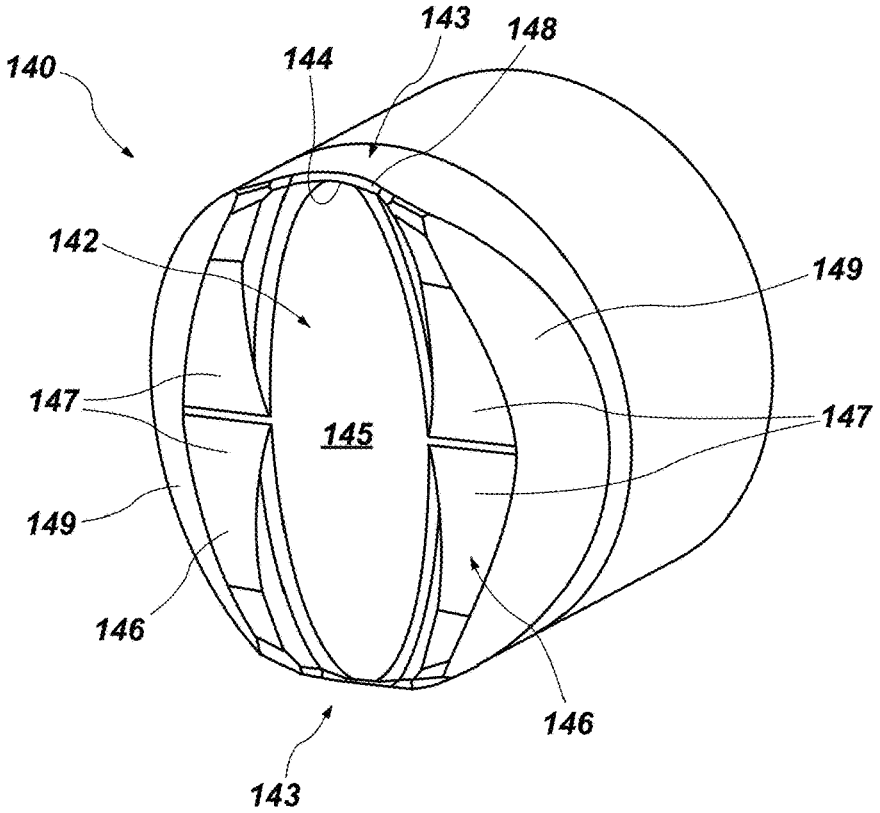
FIG. 17 is a perspective view of an embodiment of a cutting element of the present disclosure.

FIG. 17 illustrates a cutting element 140 having a front cutting surface 142 similar to that of FIG. 16. The front cutting surface 142 is symmetric along a horizontal centerline between two cutting tips 143, each having a peripheral cutting edge 144. The front cutting face 142 has a central recess 145. The region of the front cutting surface 142 within the recess 145 may be substantially planar and oriented perpendicular to the longitudinal axis of the cutting element 140, the shape of which recess 145 may be characterized as generally elliptical. On each lateral side of the central recess 145 is a generally concave ridge 146. Each ridge 146 may comprise inclined surfaces 147, which may be planar or curved, so as to provide each ridge 146 with a generally concave geometry. The cutting edge 144 of the cutting tips 143 may comprise two or more adjacent chamfer surfaces 148. The cutting element 140 of FIG. 17 further includes angled plow surfaces 149, each of which may be oriented at a plow angle relative to a plane perpendicular to the longitudinal axis of the cutting element 140 as previously described herein.

Figure 18:
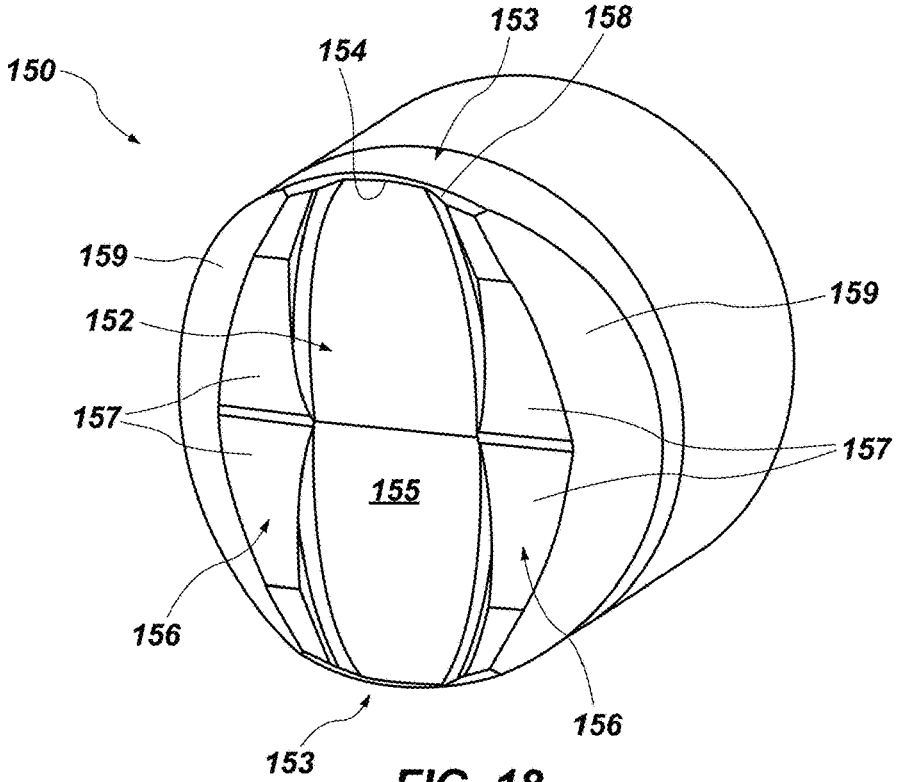
FIG. 18 is a perspective view of an embodiment of a cutting element of the present disclosure.

FIG. 18 illustrates a cutting element 150 having a front cutting surface 152 also similar to that of FIG. 16. The front cutting surface 152 is symmetric along a horizontal centerline between two cutting tips 153, each having a peripheral cutting edge 154. The front cutting face 152 has a central recess 155. In the embodiment of FIG. 18, the region of the front cutting surface 152 within the recess 155 may comprise two substantially inwardly sloped planar surfaces oriented at an angle relative to one another and to a plane oriented perpendicular to the longitudinal axis of the cutting element 150, such that this region of the front cutting surface 152 within the recess 155 has a generally concave shape. On each lateral side of the central recess 155 is a generally concave ridge 156. Each ridge 156 may comprise inclined surfaces 157, which may be planar or curved, so as to provide each ridge 156 with a generally concave geometry. The cutting edge 154 of the cutting tips 153 may comprise a chamfer surface 158 as previously described herein. The cutting element 150 of FIG. 18 further includes angled plow surfaces 159, each of which may be oriented at a plow angle relative to a plane perpendicular to the longitudinal axis of the cutting element 150 as previously described herein.

Figure 19:
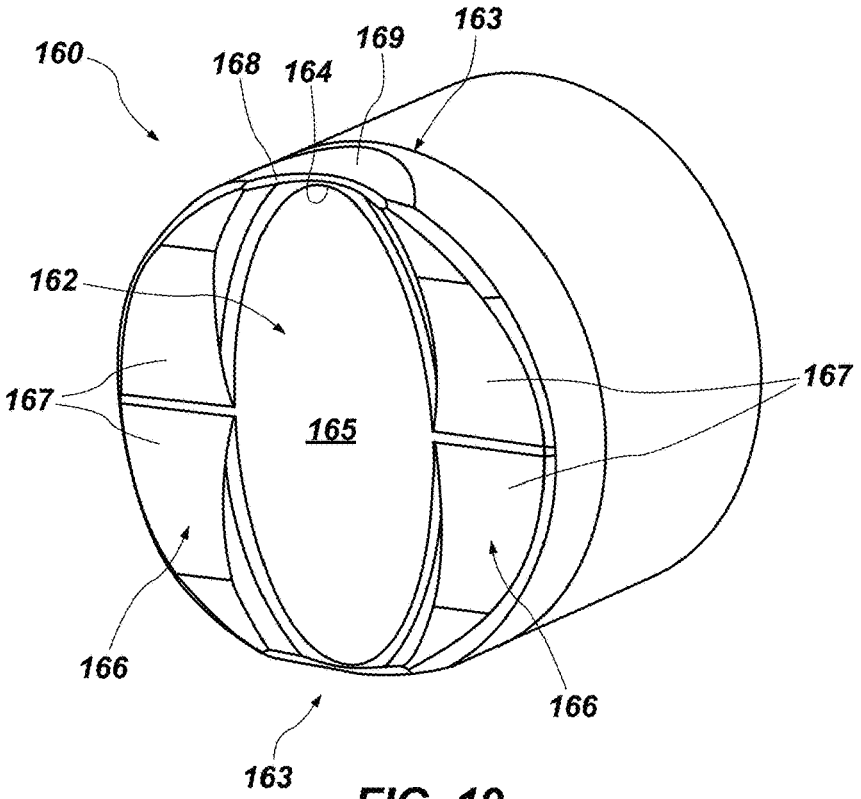
FIG. 19 is a perspective view of an embodiment of a cutting element of the present disclosure.

FIG. 19 illustrates a cutting element 160 having a front cutting surface 162. The front cutting surface 162 is symmetric along a horizontal centerline between two cutting tips 163, each having a peripheral cutting edge 164. The front cutting face 162 has a central recess 165. In the embodiment of FIG. 19, the region of the front cutting surface 162 within the recess 165 may be substantially planar and oriented perpendicular to the longitudinal axis of the cutting element 160, the shape of which may be characterized as generally elliptical. On each lateral side of the central recess 165 is a generally concave ridge 166. Each ridge 166 may comprise inclined surfaces 167, which may be planar or curved, so as to provide each ridge 166 with a generally concave geometry. The cutting edge 164 of the cutting tips 163 may comprise a chamfer surface 168 as previously described herein. The lateral side surface of the diamond table of the cutting element 160 of FIG. 19 further includes a region 169 adjacent each cutting tip 163 that has a larger radius of curvature relative to a remainder of the lateral side surface of the diamond table. In other words, the region 169 may be relatively flatter, or less curved as compared with surrounding areas of the lateral side surface of the diamond table. The region 169 may be formed by laser machining of the lateral side surface of the diamond table, for example.

In additional embodiments, the cutting element 160 could include one or more additional ridges in the central region of the front cutting surface 162 within the recess 165.

Figure 20:
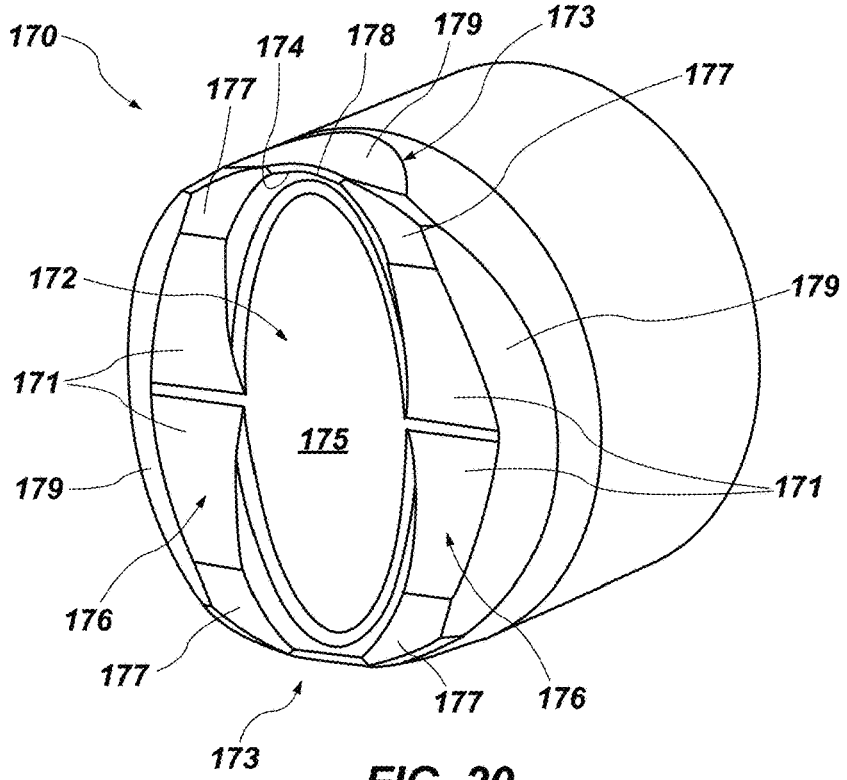
FIG. 20 is a perspective view of an embodiment of a cutting element of the present disclosure.

FIG. 20 illustrates a cutting element 170 having a front cutting surface 172. The front cutting surface 172 is symmetric along a horizontal centerline between two cutting tips 173, each having a peripheral cutting edge 174. The front cutting face 172 has a central recess 175, the shape of which may be characterized as generally elliptical. In the embodiment of FIG. 20, the region of the front cutting surface 172 within the central recess 175 may be substantially planar and oriented perpendicular to the longitudinal axis of the cutting element 170. On each lateral side of the central recess 175 is a generally concave ridge 176. Each ridge 176 may comprise inclined surfaces 177, which may be planar or curved, so as to provide each ridge 176 with a generally concave geometry. The cutting edge 174 of the cutting tips 173 may comprise a chamfer surface 178 as previously described herein. Like cutting element 160 of FIG. 19, the lateral side surface of the diamond table of the cutting element 170 of FIG. 20 further includes a region 179 adjacent each cutting tip 173 that has a larger radius of curvature relative to a remainder of the lateral side surface of the diamond table. In other words, the region 179 may be relatively flatter, or less curved as compared with surrounding areas of the lateral side surface of the diamond table. The region 179 may be formed by laser machining of the lateral side surface of the diamond table, for example. The cutting element 170 of FIG. 20 further includes angled plow surfaces 171, each of which may be oriented at a plow angle relative to a plane perpendicular to the longitudinal axis of the cutting element 170 as previously described herein.

In additional embodiments, the cutting element 170 could include one or more additional ridges in the central region of the front cutting surface 172 within the recess 175.

Figure 21:
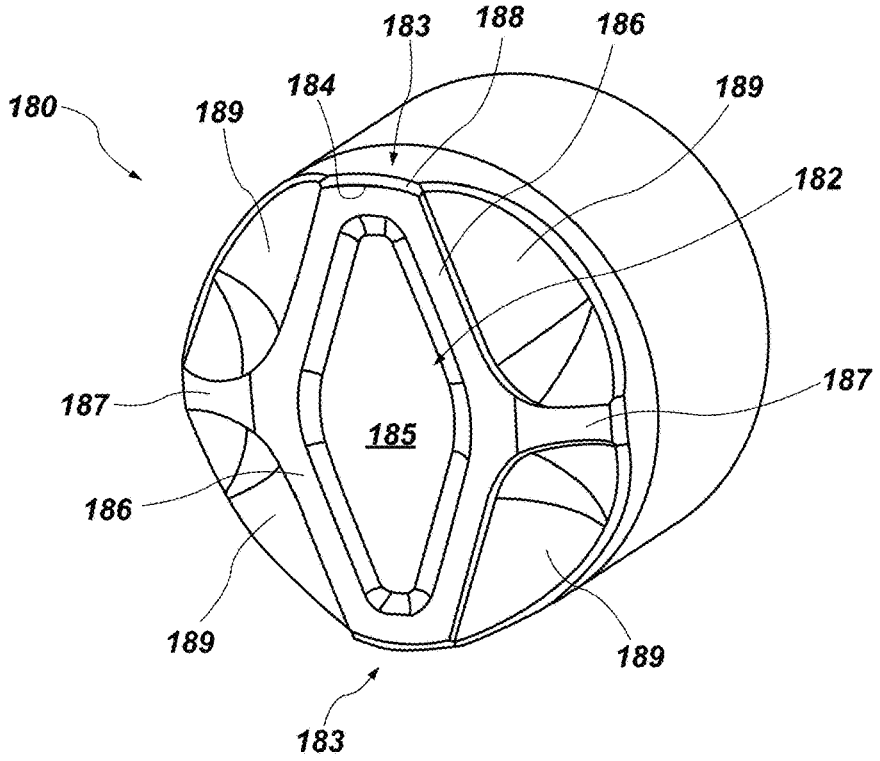
FIG. 21 is a perspective view of an embodiment of a cutting element of the present disclosure.

FIG. 21 illustrates a cutting element 180 having a front cutting surface 182. The front cutting surface 182 is symmetric along both a horizontal centerline between two cutting tips 183 and a vertical centerline extending vertically through the cutting tips 183. Each cutting tip 183 has a peripheral cutting edge 184. The front cutting face 182 has a central recess 185 having an elongated diamond shape elongated in the directions of the cutting tips 183 as shown in FIG. 21. In the embodiment of FIG. 21, the region of the front cutting surface 182 within the central recess 185 may be substantially planar and oriented perpendicular to the longitudinal axis of the cutting element 180. A generally annular ridge 186 surrounds the central recess 185, and the cutting tips 183 comprise end regions of the elongated annular ridge 186. The annular ridge 186 has a relatively uniform width around the circumference of the annular ridge 186. Four scalloped surfaces 189 surround the annular ridge 186, each of which defines a concave recess in the front cutting surface 182 of the cutting element 180. Lateral ridges 187 extend in the lateral direction from the annular ridge 186 to the outer diameter of the cutting element 180, as shown in FIG. 21. The lateral ridges 187 are integral with the generally annular ridge 186. The lateral ridges 187 may taper away from the plane of the outer surface of the annular ridge 186, in the direction toward the substrate of the cutting element 180. The cutting edges 184 of the cutting tips 183 may comprise a chamfer surface 188 as previously described herein.

Figure 22:
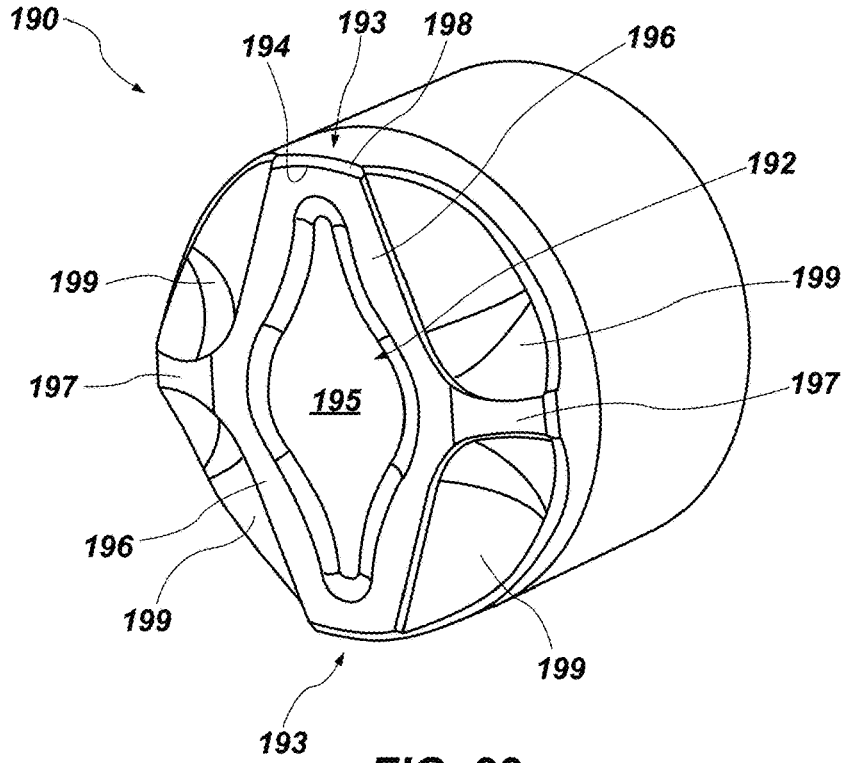
FIG. 22 is a perspective view of an embodiment of a cutting element of the present disclosure.

FIG. 22 illustrates a cutting element 190 having a front cutting surface 192. The front cutting surface 192 is symmetric along both a horizontal centerline between two cutting tips 193 and a vertical centerline extending vertically through the cutting tips 193. Each cutting tip 193 has a peripheral cutting edge 194. The front cutting face 192 has a central recess 195 having a generally elongated but irregular diamond shape that is elongated in the directions of the cutting tips 193 as shown in FIG. 22. In the embodiment of FIG. 22, the region of the front cutting surface 192 within the central recess 195 may be substantially planar and oriented perpendicular to the longitudinal axis of the cutting element 190. A generally annular ridge 196 surrounds the central recess 195, and the cutting tips 193 comprise end regions of the elongated annular ridge 196. The annular ridge 196 has a varying width around the circumference of the annular ridge 196, which results in the irregular diamond shape. As shown in FIG. 22, the width of the ridge may be thicker closer to the cutting tips 193, and thinner at a location further from the cutting tips 193. Four scalloped surfaces 199 surround the annular ridge 196, each of which defines a concave recess in the front cutting surface 192 of the cutting element 190. Lateral ridges 197 extend in the lateral direction from the annular ridge 196 to the outer diameter of the cutting element 190, as shown in FIG. 22. The lateral ridges 197 are integral with the generally annular ridge 196. The lateral ridges 197 may taper away from the plane of the outer surface of the annular ridge 196, in the direction toward the substrate of the cutting element 190. The peripheral cutting edges 194 of the cutting tips 193 may comprise a chamfer surface 198 as previously described herein.

Figure 23:
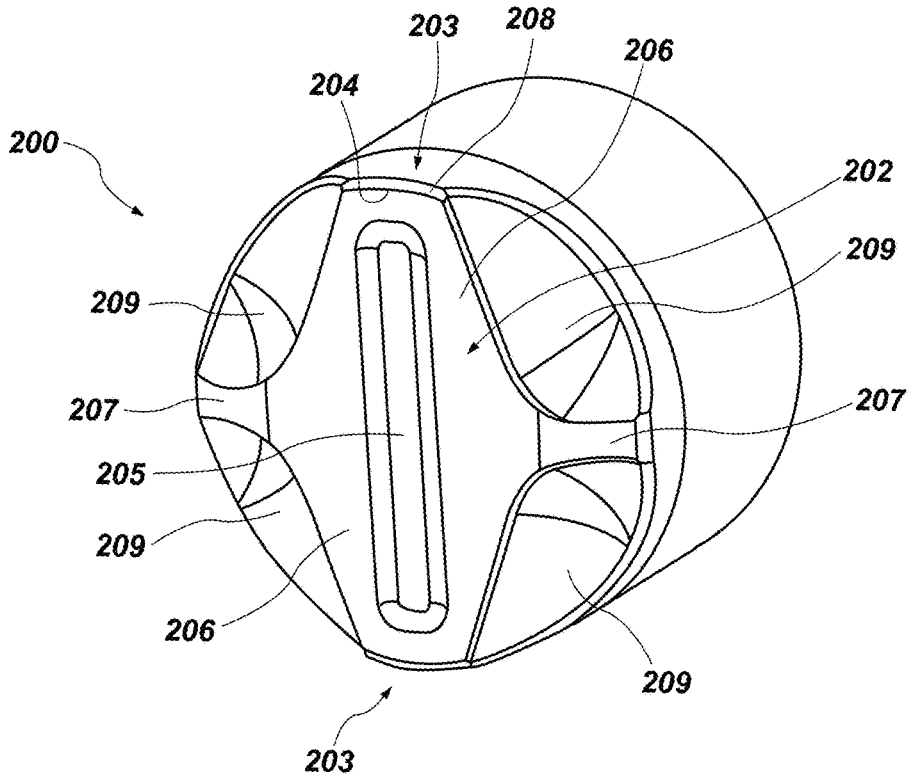
FIG. 23 is a perspective view of an embodiment of a cutting element of the present disclosure.

FIG. 23 illustrates a cutting element 200 having a front cutting surface 202. The front cutting surface 202 is symmetric along both a horizontal centerline between two cutting tips 203 and a vertical centerline extending vertically through the cutting tips 203. Each cutting tip 203 has a peripheral cutting edge 204. The front cutting face 202 has a central recess 205 having a generally elongated rectangular shape with rounded end corners, the central recess 205 being elongated in the directions of the cutting tips 203 as shown in FIG. 23. In the embodiment of FIG. 23, the region of the front cutting surface 202 within the recess 205 may be substantially planar and oriented perpendicular to the longitudinal axis of the cutting element 200. A generally annular diamond shaped ridge 206 surrounds the central recess 205, and the cutting tips 203 comprise end regions of the elongated annular ridge 206. The annular ridge 206 has a varying width around the circumference of the ridge 206. As shown in FIG. 23, the width of the ridge may be thinner closer to the cutting tips 203, and thicker at a location further from the cutting tips 203. Four scalloped surfaces 209 surround the ridge 206, each of which defines a concave recess in the front cutting surface 202 of the cutting element 200. Lateral ridges 207 extend in the lateral direction from the annular ridge 206 to the outer diameter of the cutting element 200, as shown in FIG. 23. The lateral ridges 207 are integral with the generally annular ridge 206. The lateral ridges 207 may taper away from the plane of the outer surface of the ridge 206, in the direction toward the substrate of the cutting element 200. The cutting edges 204 of the cutting tips 203 may comprise a chamfer surface 208 as previously described herein.

Figure 24:
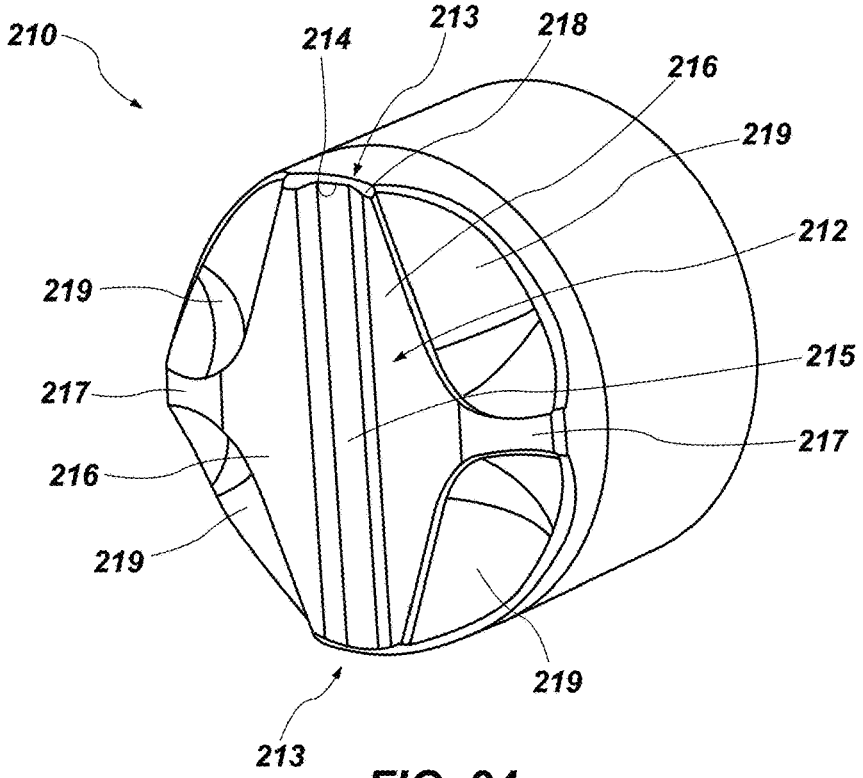
FIG. 24 is a perspective view of an embodiment of a cutting element of the present disclosure.

FIG. 24 illustrates a cutting element 210 having a front cutting surface 212. The front cutting surface 212 is symmetric along both a horizontal centerline between two cutting tips 213 and a vertical centerline extending vertically through the cutting tips 213. Each cutting tip 213 has a peripheral cutting edge 214. The front cutting face 212 has a central recess 215 having a generally elongated rectangular shape, the recess 215 being elongated in the directions of and extending to the peripheral cutting edge 214 of the tips 213 as shown in FIG. 24. In the embodiment of FIG. 24, the region of the front cutting surface 212 within the recess 215 may be substantially planar and oriented perpendicular to the longitudinal axis of the cutting element 210. A generally triangular shaped ridge 216 is disposed on each lateral side of the central recess 215, and the cutting tips 213 comprise end regions of the triangular ridges 216 as well as end regions of the front cutting surface within the recess 215. As shown in FIG. 24, the widths of the triangular ridges 216 are thinner closer to the cutting tips 213, and thicker at locations further from the cutting tips 213. Four scalloped surfaces 219 surround the ridges 216, each of which defines a concave recess in the front cutting surface 212 of the cutting element 210. A lateral ridge 217 extends in the lateral direction from each of the ridges 216 to the outer diameter of the cutting element 210, as shown in FIG. 24. The lateral ridges 217 are integral with the triangular ridges 216, respectively. The lateral ridges 217 may taper away from the plane of the outer surface of the ridge 216, in the direction toward the substrate of the cutting element 210. The cutting edges 214 of the cutting tips 213 may comprise a chamfer surface 218 as previously described herein.

Figure 25:
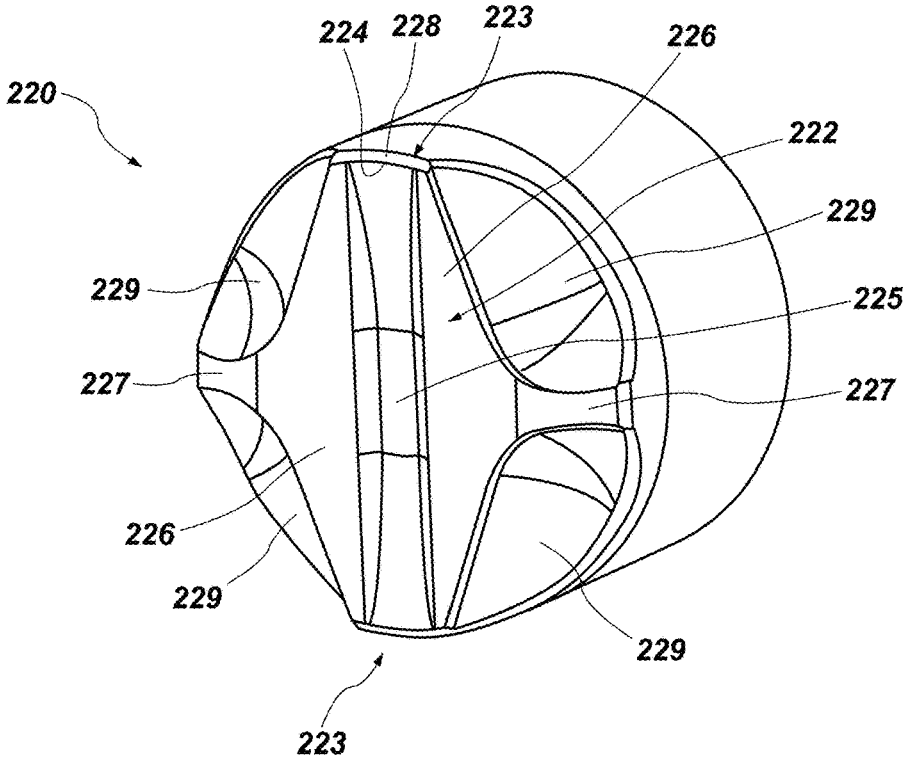
FIG. 25 is a perspective view of an embodiment of a cutting element of the present disclosure.

FIG. 25 illustrates a cutting element 220 having a front cutting surface 222. The front cutting surface 222 is symmetric along both a horizontal centerline between two cutting tips 223 and a vertical centerline extending vertically through the cutting tips 223. Each cutting tip 223 has a peripheral cutting edge 224. The front cutting face 222 has a central recess 225 having a generally elongated rectangular shape, the recess 225 being elongated in the directions of and extending to the peripheral cutting edge 224 of the tips 223 as shown in FIG. 25. In the embodiment of FIG. 25, the region of the front cutting surface 222 within the recess 225 is curved and generally concave. As illustrated, recess 225 may be configured with two inwardly sloping peripheral flats flanking a central flat. A generally triangular shaped ridge 226 is disposed on each lateral side of the central recess 225, and the cutting tips 223 comprise end regions of the elongated triangular ridges 226 as well as end regions of the concave surface within the recess 225. As shown in FIG. 25, the widths of the triangular ridges 226 are thinner closer to the cutting tips 223, and thicker at locations further from the cutting tips 223. Four scalloped surfaces 229 surround the ridges 226, each of which defines a concave recess in the front cutting surface 222 of the cutting element 220. A lateral ridge 227 extends in the lateral direction from each of the ridges 226 to the outer diameter of the cutting element 220, as shown in FIG. 25. The lateral ridges 227 are integral with the triangular ridges 226, respectively. The lateral ridges 227 may taper away from the plane of the outer surface of the ridge 226, in the direction toward the substrate of the cutting element 220. The cutting edges 224 of the cutting tips 223 may comprise a chamfer surface 228 as previously described herein.

Figure 26:
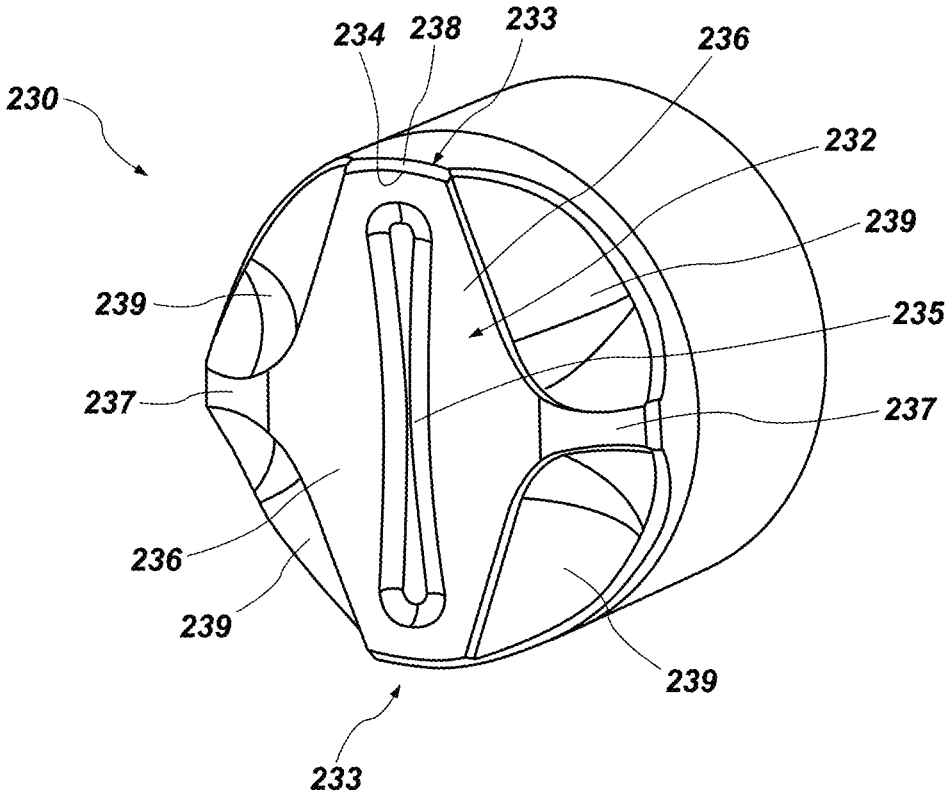
FIG. 26 is a perspective view of an embodiment of a cutting element of the present disclosure.

FIG. 26 illustrates a cutting element 230 having a front cutting surface 232. The front cutting surface 232 is symmetric along both a horizontal centerline between two cutting tips 233 and a vertical centerline extending vertically through the cutting tips 233. Each cutting tip 233 has a peripheral cutting edge 234. The front cutting face 232 has a central recess 235 having a generally elongated lobed or dog-bone shape with rounded end corners, the recess 235 being elongated in the directions of the tips 233 as shown in FIG. 26. Thus, a lateral width of the recess 235 is narrowest at the center of the recess 235 and widest at longitudinal ends of the recess 235 adjacent the cutting tips 233. In the embodiment of FIG. 26, the region of the front cutting surface 232 within the recess 235 may be substantially planar and oriented perpendicular to the longitudinal axis of the cutting element 230. A generally annular diamond shaped ridge 236 surrounds the central recess 235, and the cutting tips 233 comprise end regions of the elongated annular ridge 236. The annular ridge 236 has a varying width around the circumference of the ridge 236. As shown in FIG. 26, the width of the ridge may be thinner closer to the cutting tips 233, and thicker near the center point between the cutting tips 233. Four scalloped surfaces 239 surround the ridge 236, each of which defines a concave recess in the front cutting surface 232 of the cutting element 230. Lateral ridges 237 extend in the lateral direction from the annular ridge 236 to the outer diameter of the cutting element 230, as shown in FIG. 26. The lateral ridges 237 are integral with the generally annular ridge 236. The lateral ridges 237 may taper away from the plane of the outer surface of the ridge 236, in the direction toward the substrate of the cutting element 230. The cutting edges 234 of the cutting tips 233 may comprise a chamfer surface 238 as previously described herein.

Figure 27:
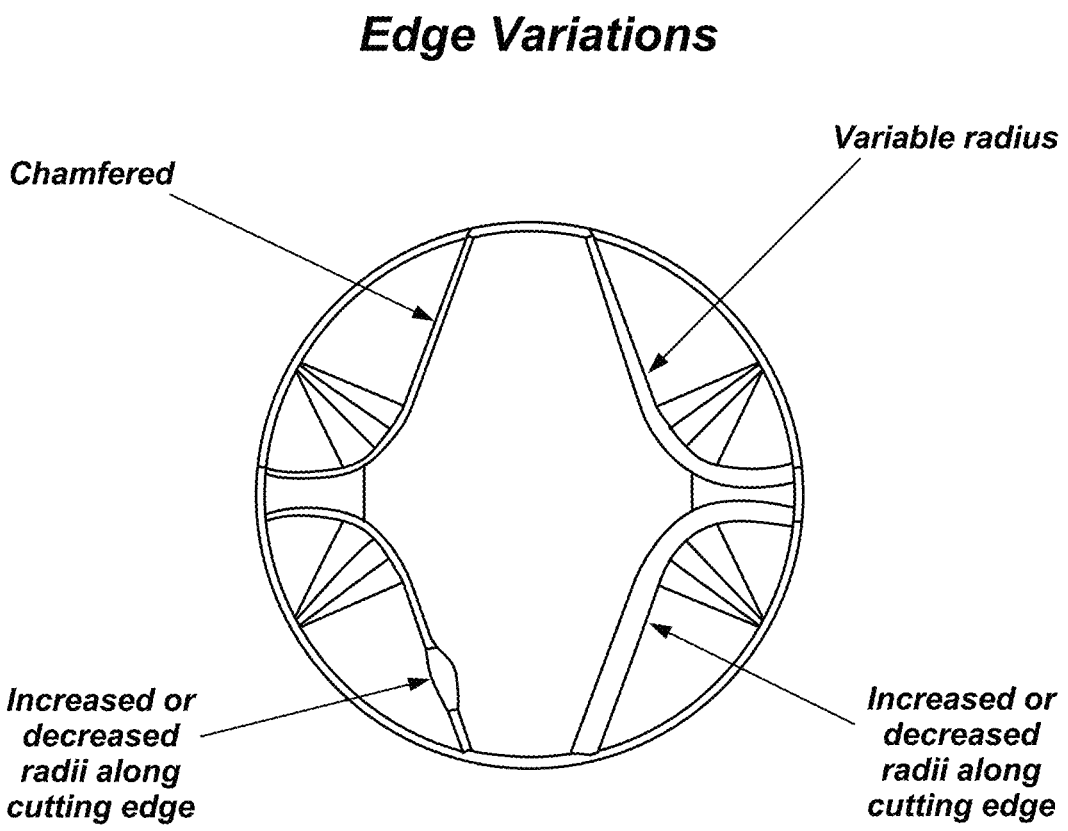
FIG. 27 is a diagram illustrating different ways in which certain features of the edges of the front cutting faces of the cutting elements of FIGS. 16-26 may be varied.

With regard to all cutting elements disclosed herein, the edges of features on the front cutting surfaces of the cutting elements may be chamfered or rounded to have a radius, so as to provide improved toughness, for example. FIG. 27 is a diagram illustrating various edge variations that may be introduced in any of the embodiments of cutting elements described herein. As shown therein, edges may be chamfered or rounded to have a radius. The radius may vary along any given edge such that the radius of curvature of the rounded edge varies along the length of any given edge.

The polycrystalline diamond of the various cutting elements disclosed herein may be machined using, for example, laser machining processes or grinding processes to form the geometries disclosed herein. Alternatively, the cutting elements may be formed to have the disclosed shape in a high-temperature, high-pressure (HTHP) sintering process used to form such polycrystalline diamond compact (PDC) cutting elements.

Furthermore, the outer surfaces of the polycrystalline diamond may be polished to reduce a surface roughness of the outer surface using, for example, a chemical polishing process, a chemical-mechanical polishing process, or a laser polishing process.

Finally, interstitial metal-solvent catalyst material present in interstitial regions between inter-bonded diamond grains in the polycrystalline diamond of the PDC cutting elements may be selectively removed from regions of the cutting elements, such as regions proximate cutting edges and cutting tips that will come into contact with the formation during drilling. Acid leaching processes are known in the industry for removing such interstitial metal-solvent catalyst material, the removal of which is known to render the cutting elements more thermally stable during drilling.

Figure 28:
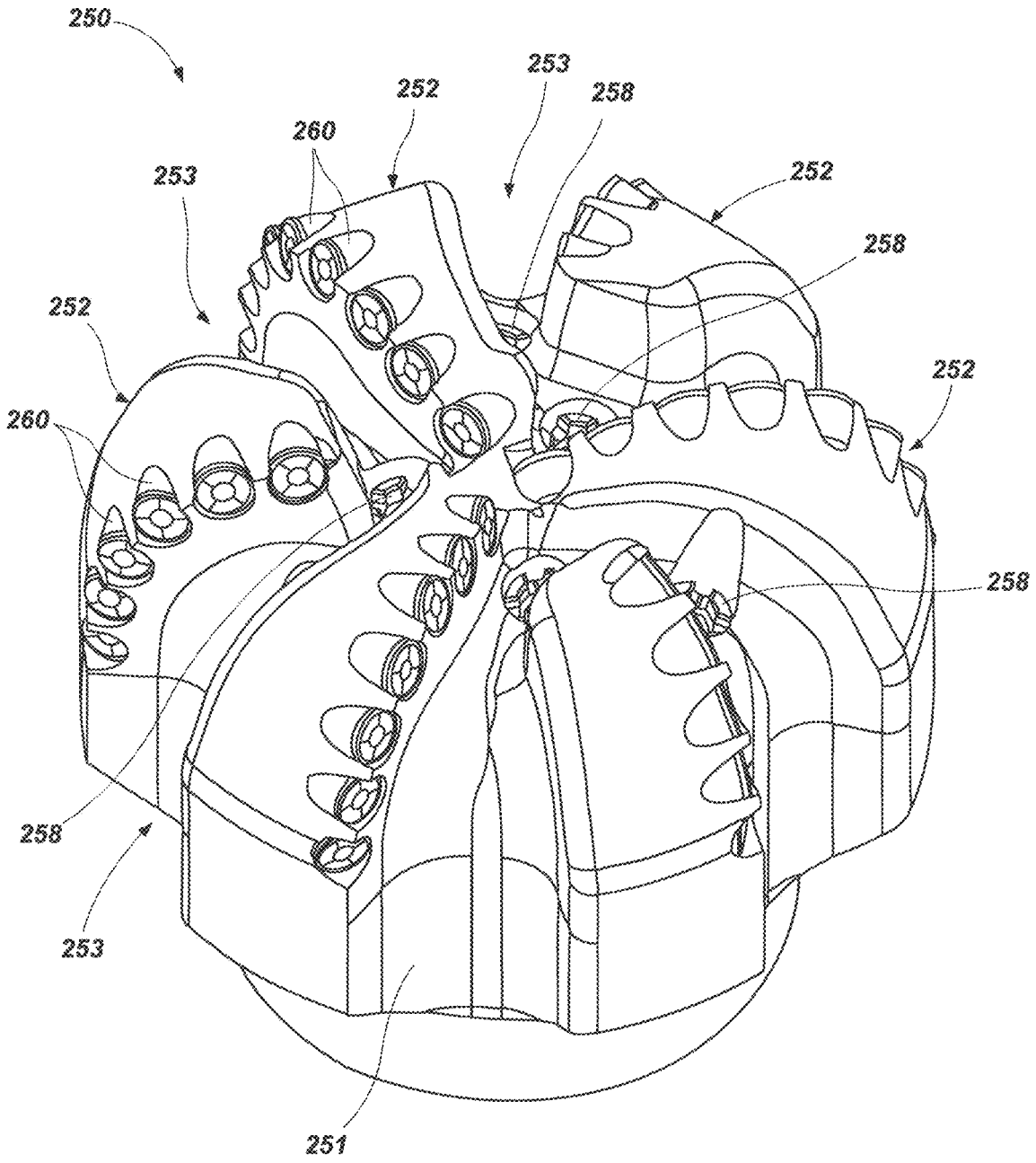
FIG. 28 is a perspective view of an earth-boring tool in the form of a fixed cutter rotary drill bit, which may include any embodiments of cutting elements as described herein, according to another embodiment of the present disclosure.

PDC cutting elements as described herein may be attached to a tool body of an earth boring tool and used to form and/or enlarge a wellbore in a subterranean formation. For example, FIG. 28 illustrates an embodiment of an earth-boring tool of the present disclosure. The earth-boring tool of FIG. 28 is a fixed-cutter rotary drill bit 250 having a bit body 251 that includes a plurality of blades 252 that project outwardly from the bit body 251 and are separated from one another by fluid courses 253. The portions of the fluid courses 253 that extend along the radial sides (the "gage" areas of the drill bit 250) are often referred to in the art as "junk slots." The bit body 251 further includes a generally cylindrical internal fluid plenum, and fluid passageways that extend through the bit body 251 to the exterior surface of the bit body 251. Nozzles 258 may be secured within the fluid passageways proximate the exterior surface of the bit body 251 for controlling the hydraulics of the drill bit 250 during drilling. A plurality of cutting elements 260 is mounted to each of the blades 252. The cutting elements 260 may be or comprise any of the various embodiments of PDC cutting elements as described herein.

During a drilling operation, the drill bit 250 may be coupled to a drill string (not shown). As the drill bit 250 is rotated within the wellbore, drilling fluid may be pumped down the drill string, through the internal fluid plenum and fluid passageways within the bit body 251 of the drill bit 250, and out from the drill bit 250 through the nozzles 258. Formation cuttings generated by the cutting elements 260 of the drill bit 250 may be carried with the drilling fluid through the fluid courses 253, around the drill bit 250, and back up the wellbore through the annular space within the wellbore outside the drill string.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described in relation to the various embodiments of cutting elements disclosed herein, will become apparent to those skilled in the art from the description. It is contemplated that surfaces or geometries disclosed in relation to one embodiment of a cutting element may be incorporated in whole or in part into other disclosed embodiments of cutting elements where technically feasible. Such modifications and embodiments are also intended to fall within the scope of the appended claims and equivalents.

What is claimed is:

1. A cutting element for an earth-boring tool, comprising:

a substrate; and a volume of polycrystalline diamond on the substrate, the volume of polycrystalline diamond having exterior surfaces defining a front cutting surface, a peripheral edge, and a pair of angled tip surfaces defining a cutting tip between the pair of angled tip surfaces, wherein the cutting tip has dual cutting peaks, the front cutting surface includes a first planar region and a second planar region, the second planar region including the cutting tip, the second planar region oriented at an angle relative to the first planar region such that the front cutting surface is generally concave, the second planar region oriented at an acute angle relative to relative to a plane perpendicular to a longitudinal axis of the cutting element.

2. The cutting element of claim 1, wherein the cutting tip extends to a height above the first planar region of the front cutting surface.

3. The cutting element of claim 1, wherein the first planar region of the front cutting face is oriented perpendicular to the longitudinal axis of the cutting element.

4. The cutting element of claim 1, wherein the exterior surfaces of the volume of polycrystalline diamond further define angled plow surfaces on opposite lateral sides of the cutting tip, the angled plow surfaces disposed at an acute angle relative to a plane perpendicular to the longitudinal axis of the cutting element.

5. The cutting element of claim 1, wherein the cutting tip has a tip width in a range extending from 0.080 inch to 0.173 inch.

6. The cutting element of claim 1, wherein the angled tip surfaces are planar and oriented relative to one another at a tip angle of about 90°.

7. The cutting element of claim 1, wherein the substrate is cylindrical.

8. The cutting element of claim 1, wherein the exterior surfaces of the volume of polycrystalline diamond further define another pair of angled tip surfaces defining another cutting tip between the another pair of angled tip surfaces, the another cutting tip located in a third planar region oriented at an angle relative to the first planar region.

9. The cutting element of claim 8, wherein the another cutting tip has dual cutting peaks.

10. A cutting element for an earth-boring tool, comprising:

a substrate; and a volume of polycrystalline diamond on the substrate, the volume of polycrystalline diamond having exterior surfaces defining a front cutting surface, a peripheral edge, and a pair of angled tip surfaces defining a cutting tip between the pair of angled tip surfaces, wherein the front cutting surface includes a first planar region and a second planar region, the second planar region oriented at an angle relative to the first planar region such that the front cutting surface is generally concave, the second planar region oriented at an acute angle relative to relative to a plane perpendicular to a longitudinal axis of the cutting element, the front cutting surface further including a planar face region at the cutting tip, the planar face region oriented perpendicular to the longitudinal axis of the cutting element, wherein the planar face region at the cutting tip, the first planar region of the front cutting surface, and the second planar region of the front cutting surface are arranged such that a line perpendicular to and intersecting the longitudinal axis of the cutting element and intersecting a midpoint of the cutting tip extends across each of the first planar region of the front cutting surface and the second planar region of the front cutting surface when viewed along the direction of the longitudinal axis of the cutting element.

11. The cutting element of claim 10, wherein the cutting tip has dual cutting peaks.

12. The cutting element of claim 10, wherein the exterior surfaces of the volume of polycrystalline diamond further define another pair of angled tip surfaces defining another cutting tip between the another pair of angled tip surfaces, and the front cutting surface further includes another planar face region at the another cutting tip, the another planar face region oriented perpendicular to the longitudinal axis of the cutting element.

13. The cutting element of claim 12, wherein the cutting tip and the another cutting tip each have dual cutting peaks.

* * * * *